United States Patent [19]

Greenspan

[11] Patent Number: 4,929,149

[45] Date of Patent: May 29, 1990

[54] GAS BLOWER

[75] Inventor: Alexander Greenspan, Chesterland, Ohio

[73] Assignee: Superstream, Inc., Warrensville Heights, Ohio

[21] Appl. No.: 265,284

[22] Filed: Oct. 26, 1988

Related U.S. Application Data

[63] Continuation of Ser. No. 175,649, Mar. 21, 1988, abandoned, which is a continuation of Ser. No. 864,927, May 19, 1986, abandoned, which is a continuation-in-part of Ser. No. 689,642, Jan. 8, 1985, abandoned.

[51] Int. Cl.[5] ..... F01D 3/02

[52] U.S. Cl. ..... 415/99; 415/93

[58] Field of Search ..... 415/99, 100, 26, 126, 415/131, 132, 203, 204, 206, 213 A, 93

[56] References Cited

U.S. PATENT DOCUMENTS

| | | | |
|---|---|---|---|
| 1,158,569 | 11/1915 | Sebald | 415/99 |
| 1,395,464 | 11/1921 | Woock et al. | 415/99 |
| 2,235,050 | 3/1941 | Thege et al. | 415/100 |
| 2,362,514 | 11/1944 | Warner | 415/207 |
| 3,044,683 | 7/1962 | Woollenweber | 415/143 |
| 3,303,996 | 2/1967 | Bayless | 415/207 |
| 3,382,809 | 5/1968 | Bookout et al. | 415/17 |
| 3,692,422 | 9/1972 | Girardier | 415/121 B |
| 4,563,124 | 1/1986 | Eskew | 415/98 |

FOREIGN PATENT DOCUMENTS

| | | | |
|---|---|---|---|
| 84822 | 11/1935 | Belgium | 415/203 |
| 926107 | 3/1955 | Fed. Rep. of Germany | 415/209 |
| 406396 | 4/1942 | Italy | 416/223 B |
| 93997 | 1/1983 | Japan | 415/209 |
| 541923 | 10/1955 | Sweden | 415/99 |
| 323107 | 7/1957 | Switzerland | 415/99 |

*Primary Examiner*—Robert E. Garrett
*Assistant Examiner*—John T. Kwon
*Attorney, Agent, or Firm*—Panitch Schwarze Jacobs and Nadel

[57] ABSTRACT

A gas blower comprises a generally cylindrical housing containing a generally annular radially symmetric impeller chamber and a generally annular and generally radially symmetric plenum chamber. The housing has a gas inlet opening to the impeller chamber and a gas outlet opening from the plenum chamber. The radially outer portion of the impeller chambers in fluid communication with the radially outer portion of the plenum chamber. The blower further comprises a rotatable drive shaft extending axially within at least a portion of the housing and an impeller mounted on the drive shaft for rotation within the impeller chamber. The impeller is mounted for a generally axially intake of gas from the inlet opening and a generally centrifugal radially symmetric exhaust of the gas within the axial component in the axial direction opposite to the direct of the gas intake. Thus, the axial component of force with the gas exhausted from the impeller is opposite the axial component of force of the gas intake to the impeller. In one embodiment, the blower comprises a pair of individual blowers including a common housing and a pair of opposed, axially spaced impellers. This dual, inline opposed and balanced gas blower possesses minimum end thrust during operation. A novel arrangement permits expeditious removal of the bearings from the blower without requiring disassembly of the entire blower.

17 Claims, 15 Drawing Sheets

GAS BLOWER

BACKGROUND OF THE INVENTION

This invention relates in general to gas blowers, and more particularly to a mixed flow blower for exhausting and pressurizing gas to move the gas at relatively high flow rates through a gas line system.

Increasingly, society faces a solid waste management crisis. As the solid waste produced by a consumption-oriented society continues to increase, acceptable solid waste landfill disposal sites are increasingly difficult to identify. Noxious gases produce by decomposition of organic matter in solid waste landfills contribute strongly to the environmental unacceptability of landfills. In addition, flammable noxious gases which are not efficiently extracted from landfills constitute a wasted energy resource.

Centrifugal blowers which may be used to pressurize gas, such as methane gas originating from decomposition of organic material in landfills, and for moving the gas through a pipe line system, are known in the art. However, presently available blowers frequently do not have long service lives and are generally difficult to service in the field. Further, servicing presently available blowers frequently requires significant disruption of the pipe line system in which the blower is installed. Often such blowers must be removed and transported with difficulty to a remotely located repair facility.

Frequently, presently available blowers are heavy units which consume substantial amounts of energy in exhausting gases and provide relatively low inlet vacuum. These blowers are generally constructed and arranged so that they develop considerable unbalanced thrust forces relative to the shaft of the blower, ultimately resulting in bearing wear and possible failure.

In addition, prior art blowers are often subject to catastropic failure when the fluid drawn into the blower includes liquids, or gases which are readily condensible in elevated pressure regions of the blower. Prior art blowers are often especially adapted for use in exhausting specific gases within narrow flow rate ranges and thus are relatively non-versatile.

There is a need for an efficient system for removing waste gases generated by landfill sites in general. More specifically, there is a need for a gas blower to drive such gas removal systems which is energy efficient, compact, versatile and designed to require little maintenance, and which is relatively easy to service in the field.

The present invention meets these needs and is particularly adapted for use in extracting and pressurizing gas so that it can be moved through a pipe line system at relatively high flow rates. Further, the present invention provides additional advantages which are described below.

SUMMARY OF THE INVENTION

The present invention provides a mixed flow gas blower comprising a generally cylindrical housing containing a generally annular radially symmetric impeller chamber, and a generally annular and generally radially symmetric plenum chamber. The housing has a gas inlet opening to the impeller chamber and a gas outlet opening from the plenum chamber. The radially outer portion of the impeller chamber is in fluid communication with the radially outer portion of the plenum chamber.

The blower further comprises a rotatable drive shaft extending axially within at least a portion of the housing and an impeller mounted on the drive shaft for rotation within the impeller chamber. The impeller is adapted for a generally axial intake of gas from the inlet opening and generally centrifugal radially symmetric exhaust of the gas with an axial component in the axial direction opposite to the direction of the gas intake. Thus, the axial component of force of the gas exhausted from the impeller is opposite the axial component of force of the gas intake to the impeller.

In one presently preferred embodiment, the present invention provides a dual mixed flow gas blower comprising a pair of individual blowers including a common housing and a pair of opposed, axially spaced impellers. This dual, inline, opposed and balanced gas blower provides minimum end thrust during operation since the end thrust of each of the individual blowers, which is minimized by balancing the axial intake and exhaust of gas, is opposed and balanced against the end thrust of the other individual blower.

The present invention also provides a novel arrangement for expeditious removal of the bearings from the blower, without requiring disassembly of the entire blower.

BRIEF DESCRIPTION OF THE DRAWINGS

The foregoing summary as well as the following detailed description of presently preferred embodiments of the invention will be better understood when read in conjunction with the appended drawings; it being understood, however, that this invention is not limited to the precise arrangements illustrated. In the drawings.

DETAILED DESCRIPTION OF THE PREFERRED EMBODIMENTS

Blower Structure

Figure 2:
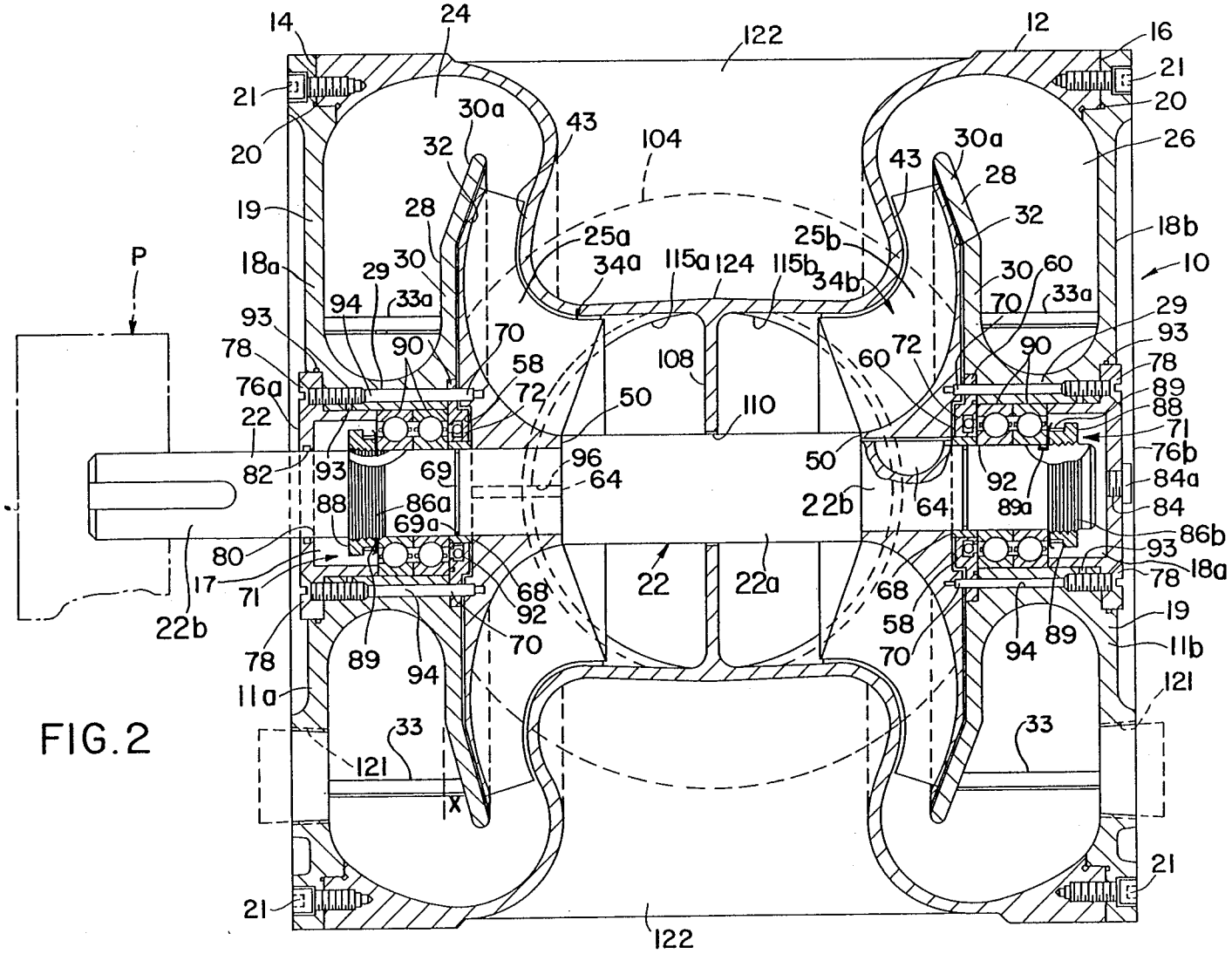
FIG. 2 is a longitudinal vertical sectional and partially broken view of the dual blower of FIG. 1.
Figure 5:
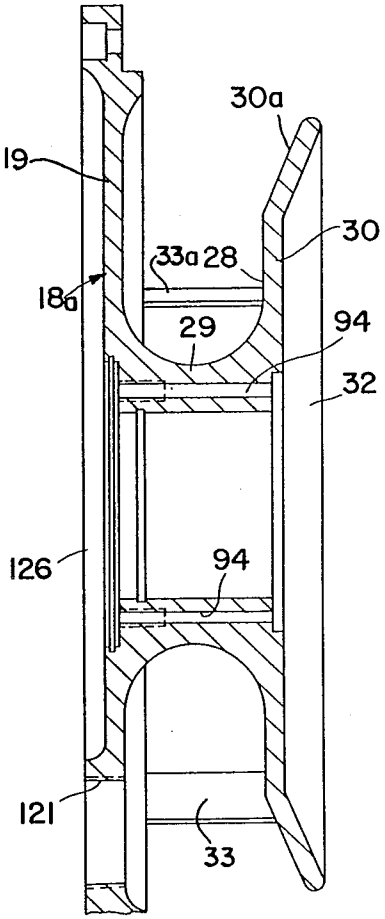
FIG. 5 is a sectional view taken generally along the plane of line 5—5 of FIG. 4.
Figure 4:
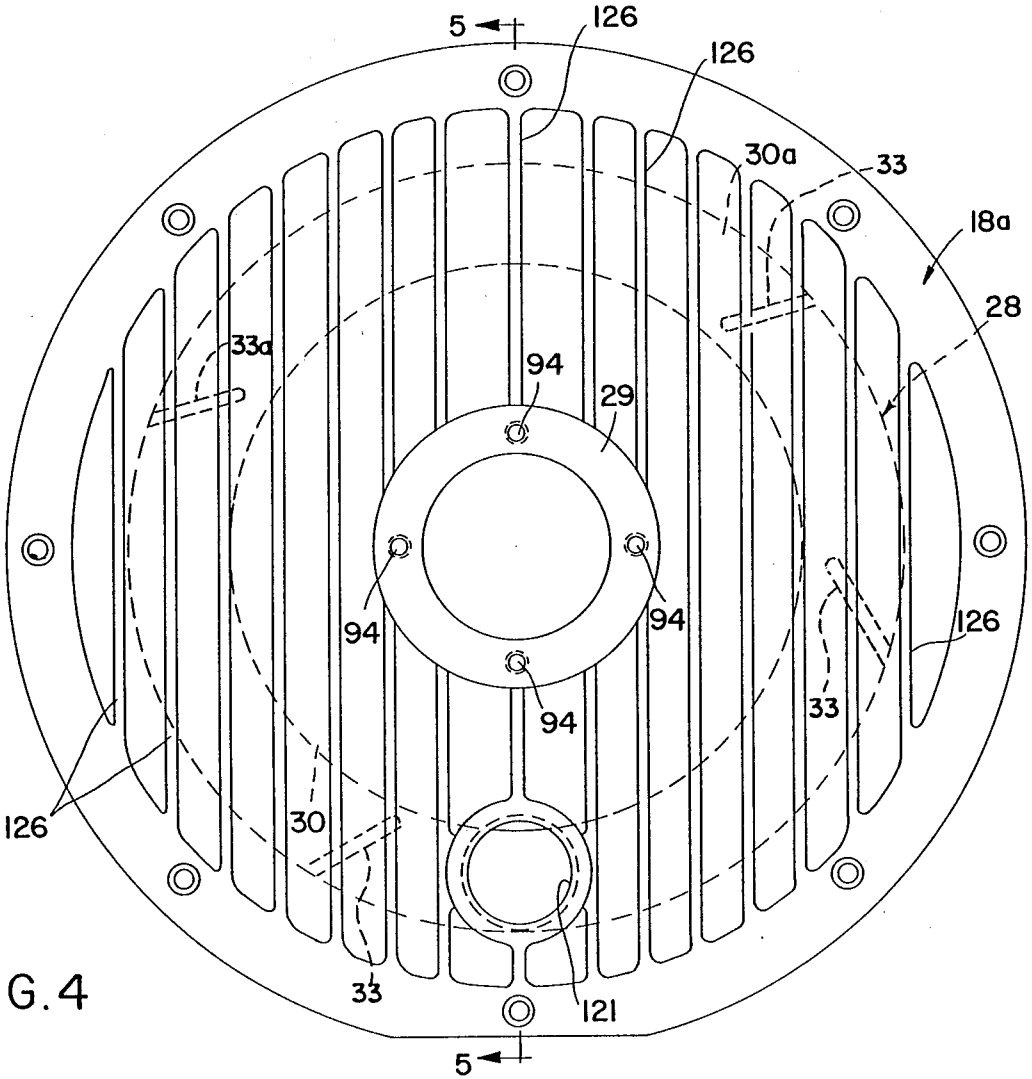
FIG. 4 is an elevational view of an end cap member of the dual blower of FIG. 2.

Referring to the drawings wherein like numerals indicate like elements throughout the several views, and particularly to FIGS. 2, 4 and 5, it can be seen that the present invention in one presently preferred embodiment provides a dual mixed flow blower 10 comprising a single stationary casing or housing 12 which houses a pair of opposed, in-line mixed flow blowers 11*a*, 11*b*.

The housing 12 is generally open at both axial or longitudinal ends 14, 16 (FIG. 2). End cap members 18*a*, 18*b* (FIGS. 2, 4 and 5) are provided for closing the respective open ends of the housing 12. The end cap members 18*a*, 18*b* may be provided with conventional sealing means, such as o-rings 20 (FIG. 2) or packing (not illustrated), or the like, for sealing the juncture between each end cap member 18*a*, 18*b* and its respective open end of the housing 12, thus preventing the leakage of gas. Threaded fastener means such as bolts 21 are provided for removably securing the end cap members 18*a*, 18*b* to the housing 12 to form a fluid tight seal.

As best seen in FIG. 2, a rotatable shaft 22 extends axially or longitudinally of housing 12 and into spaced plenum chambers 24, 26 defined by the housing 12 and the end cap members 18*a*, 18*b*. Each of the end cap members 18*a*, 18*b* includes an integral barrier wall 28 secured to a generally circular plate section 19 by means of a connecting hub section 29. A plurality of generally planar vanes 33, 33*a* extend between each of the barrier walls 28 to the respective plate sections 19 to direct gas flow within the dual blower 10 as described below. The barrier walls 28 have a generally circular outer periphery, as can be seen in phantom in FIG. 4. Each of the barrier walls 28 serves to separate a generally annular, radially symmetric impeller chamber 25*a*, 25*b* from a generally annular, generally radially symmetric plenum chamber 24, 26. However, since the barrier walls 28 do not extend to the wall of the housing 12 the radially outer portion of each impeller chamber 25*a*, 25*b* is in fluid communication with the radially outer portion of its respective plenum chamber 24, 26 through the generally annular space proximate the outer periphery of the barrier walls 28.

Figure 1:
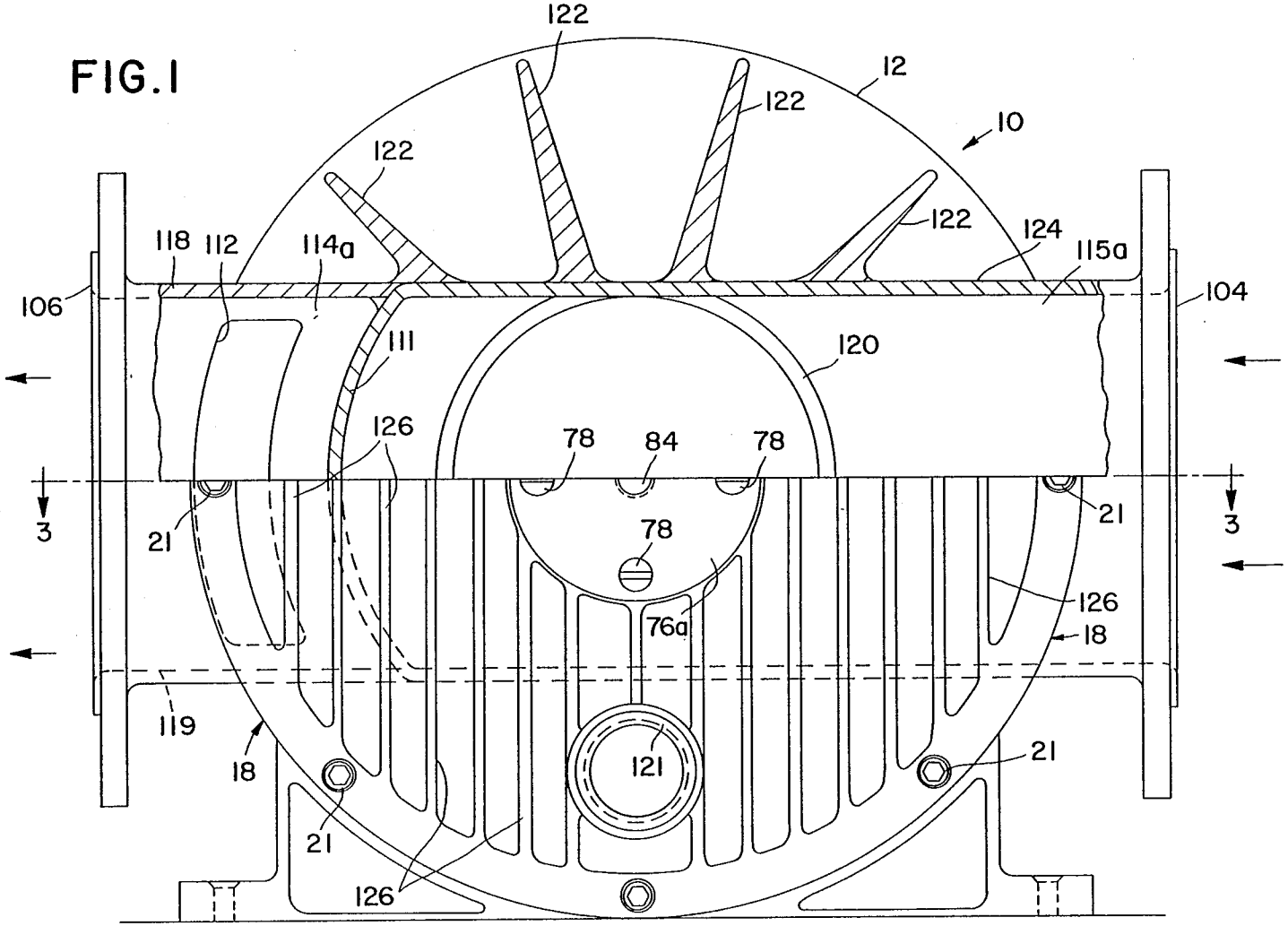
FIG. 1 is a partially sectional end view of a dual gas blower in accordance with a preferred embodiment of the present invention, and taken from the right end of the blower structure as viewed in FIG. 2.
Figure 9:
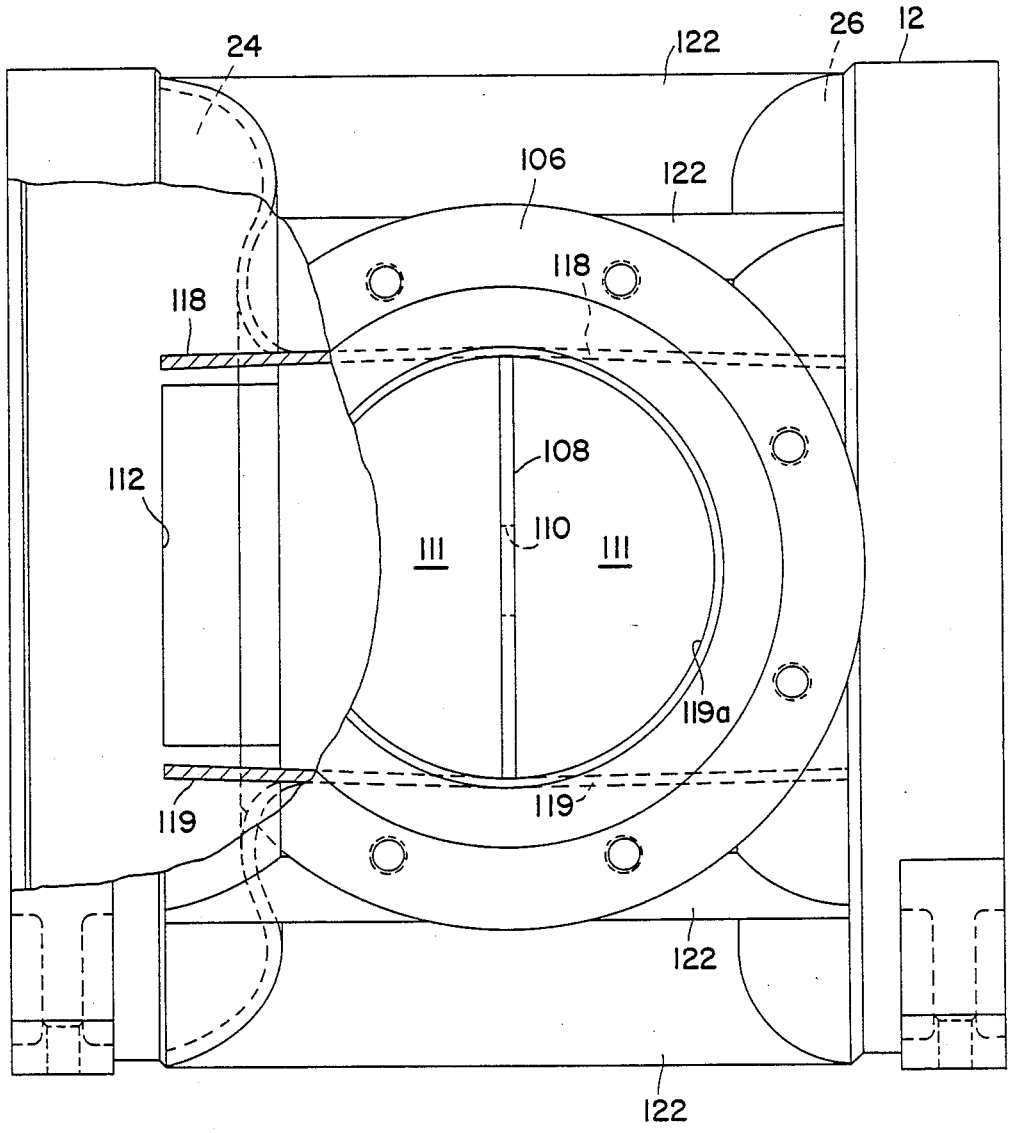
FIG. 9 is a partially broken, elevational view of the blower housing of FIG. 1–3 taken from the gas outlet side of the blower; the end cap members of the blower housing have been deleted from this view.
Figure 10:
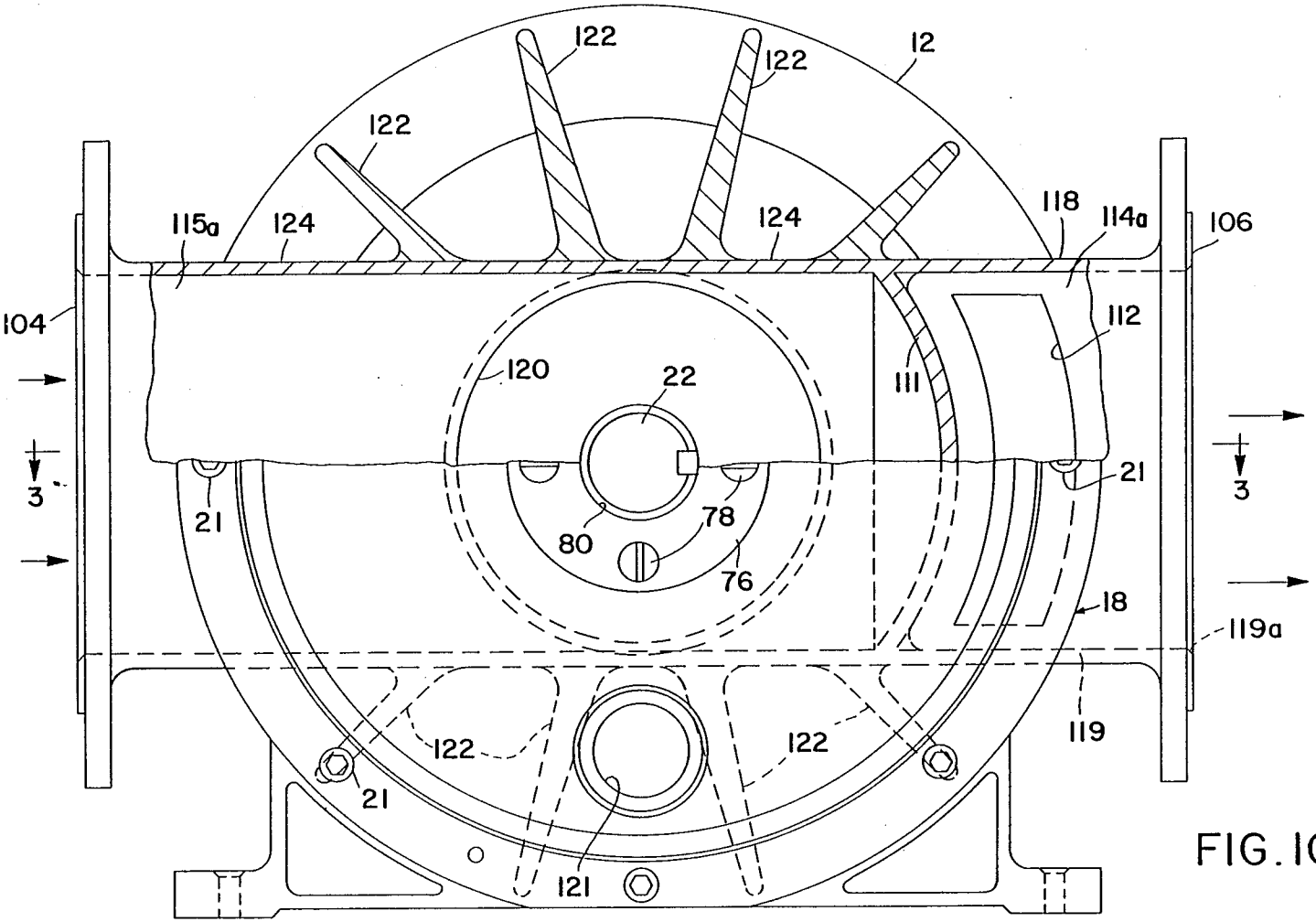
FIG. 10 is a partially broken, elevational view of the blower of FIG. 2 taken from the left end (with reference to FIG. 2) of the blower; the cooling ribs on the end plate having been deleted.
Figure 11:
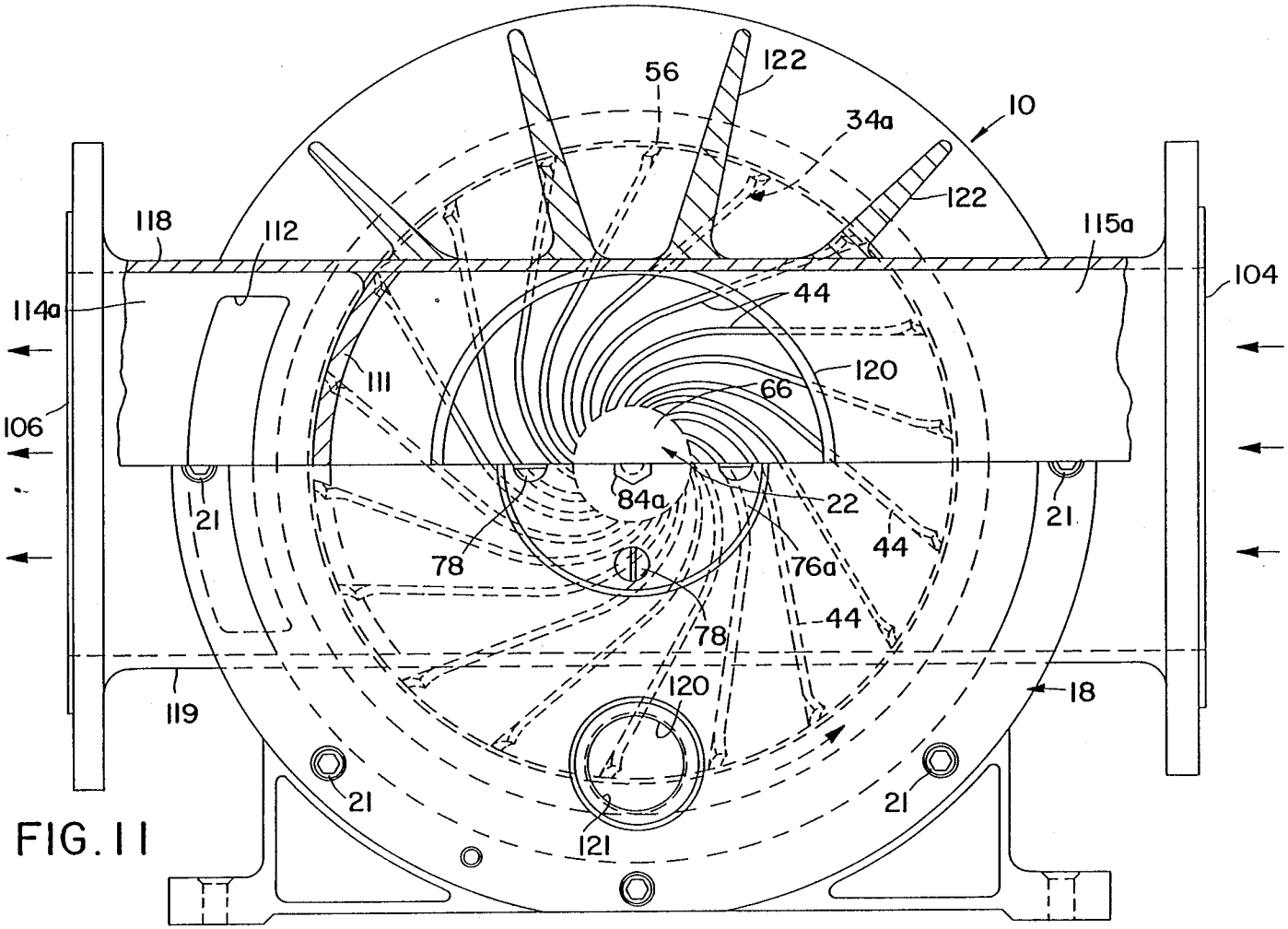
FIG. 11 is a partially broken, end elevational view of the blower of FIG. 2 taken from the right end (with reference to FIG. 2) of the blower.
Figure 12:
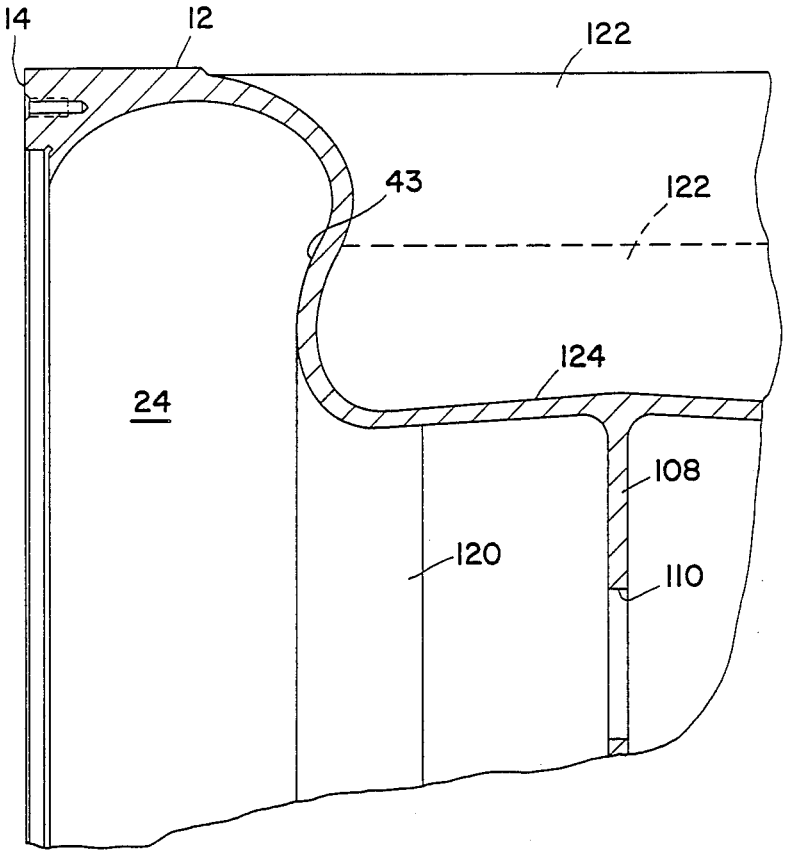
FIG. 12 is an enlarged partial sectional view taken generally along the plane of line 12—12 of FIG. 3.

Referring now in particular to FIGS. 1, 2 and 10, there are provided a plurality of spaced cooling and strengthening ribs 122 extending outwardly from the body 124 of the blower 10 intermediate the impeller chambers 25*a*, 25*b*. The cooling ribs 122 merge, as can seen in FIGS. 2 and 9, with the exterior of the respective impeller chambers 25*a*, 25*b*. As shown in FIGS. 4 and 5, the end cap members 18*a*, 18*b* are also each preferably provided with a plurality of exterior spaced generally vertically extending ribs 126 which also aid in dissipation of heat generated by the blower 10 as well as strengthening the end cap members 18*a*, 18*b*. The end cap members 18*a*, 18*b* are thus stiff enough to prevent excessive vibrations.

Barrier Walls

Barrier walls 28 in the presently preferred embodiment illustrated in FIG. 2 each comprise a generally radially outwardly extending inner section 30 and a generally obliquely extending outer section 30*a* projecting from the distal or radially outer portion of the inner section 30 and sloping generally inwardly therefrom toward the impeller chamber 25*a*, 25*b*. The outer section 30*a* of the barrier wall 28 makes an acute angle X with respect to a plane perpendicular to the longitudinal axis of the housing 12 and shaft 22 for a purpose which will be hereinafter described. By forming the barrier walls 28 in this manner, they are substantially more rigid than corresponding prior art walls which generally extend only radially outwardly. The enhanced rigidity reduces the noise and vibration of the blower 10.

The inner section 30 and outer section 30*a* of the barrier walls 28 together define relatively shallow recesses 32 (FIG. 5) which are adapted to receive therein a portion of each of the associated rotatable impeller members or impellers 34*a*, 34*b* (FIG. 2) disposed in the respective impeller chambers 25*a*, 25*b*. The barrier walls 28, impellers 34*a*, 34*b*, impeller chambers 25*a*, 25*b* and plenum chambers 34, 36 share a common axis of symmetry.

When each end cap member 18*a*, 18*b* is attached to its respective open end of the housing 12, so as to close the respective open housing end, each end cap member 18*a*, 18*b* mounts its respective barrier wall 28 in its proper position with respect to its associated impeller 34*a*, 34*b*. In operation of the blower 10, when the pressure in the plenum chambers 24, 26 rises, the right end cap member 18*b* (with respect to FIG. 2) acts as a diaphragm, expanding slightly outwardly to relieve stress as described below.

Figure 13:
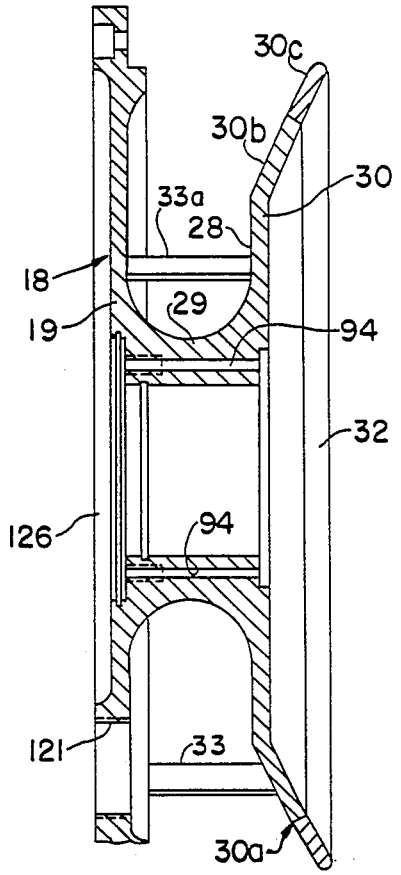
FIG. 13 is a vertical sectional view of an end cap member of another embodiment of the present invention illustrating an alternative barrier wall structure.

In an alternative embodiment illustrated in FIG. 13 the generally obliquely extending section 30*a* of the barrier walls 28 comprises two distinct subsections jointed end-to-end. A first subsection 30*b* extends from the distal end of and is formed integrally with the generally radially extending inner section 30, and a second subsection 30*c* is secured to and extends from the distal end of the first subsection 30*b*.

The second subsection 30*c* is preferably generally annular and ring-like and is formed from an engineering plastic material such as an engineering grade polyurethane selected to withstand the elevated temperatures which occur within the blower 10 during operation. The second subsection 30*c* may be joined to the first subsection 30*b* by mechanical means; such as by a press fit or the like, or by adhesive bonding, or by any other suitable means known in the art. As indicated below, the second subsection 30c extends the overall radial length of the barrier walls 28, thereby limiting the flow of gas through the blower 10 when it is desirable to alter the performance characteristics of the blower 10.

Impellers

Figure 8:
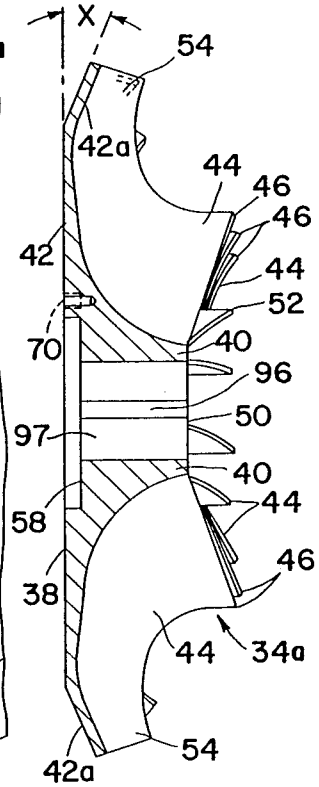
FIG. 8 is a sectional view taken generally along the plane of line 8—8 of FIG. 6.
Figure 7:
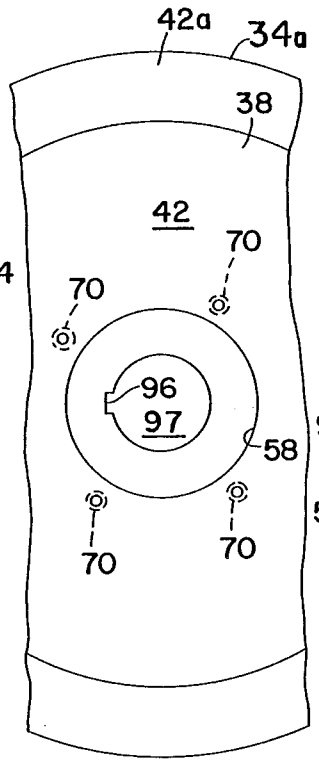
FIG. 7 is a fragmentary, elevational view taken from the other or outer side of the impeller of FIG. 6.
Figure 6:
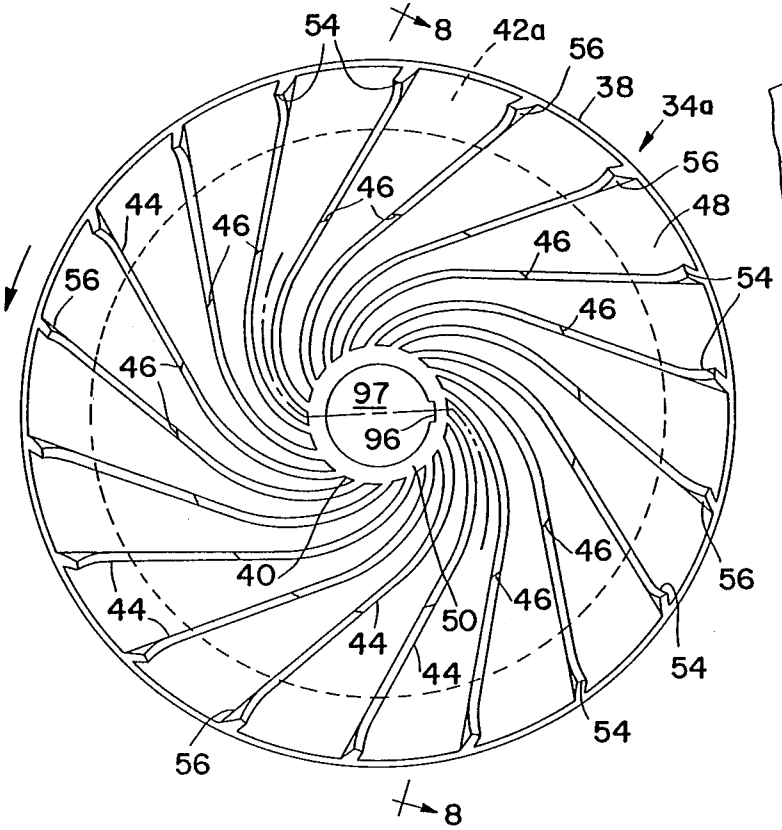
FIG. 6 is an elevational view of the inner side of the left impeller of the blower of FIG. 2.

Referring now in particular to FIGS. 6–8 in conjunction with FIG. 2, each impeller 34a, 34b comprises a backing plate 38 having a circular periphery (FIGS. 6 and 7). The backing plate 38 is formed integrally with the hub portion 40, the backing plate 38 comprising a first generally radially extending section 42 and a second outer generally diagonally inwardly extending section 42a. The backing plate 38 is formed generally complementary to the corresponding sections 30, 30a of the barrier wall 28.

In the embodiment illustrated in FIGS. 2 and 8, the outer section 42a of the impeller backing plate 38 is disposed at substantially the same acute angle X with respect to a plane perpendicular to the longitudinal axis of the blower 10 as is the outer section 30a of the barrier wall 28 which it confronts. In the presently preferred embodiment this acute angle is approximately 22.5 degrees. As discussed below, the angle X is empirically chosen primarily to reduce vibration and the net axial thrust force of each of the individual blowers 11a, 11b of the dual blower 10.

The clearance between each of the the impellers 34a, 34b and the respective barrier walls 28 is preferably on the order of 12 to 15 thousandths of an inch (0.0030–0.0038 cm). Thus, the backing plate 38 of each of the impellers 34a, 34b is positioned in close proximity to the respective barrier wall 28, and back flow through the impeller chambers 25a, 25b is reduced.

As illustrated in FIG. 2, each of the impellers 34a, 34b is also positioned in close proximity to the portion of the confronting inner surface 43 of the housing 12. The inner surface 43 of the housing 12 proximate each of the impellers 34a, 34b defines a boundary of the respective impeller chamber 25a, 25b within which each impeller 34a, 34b is positioned. The close tolerances between the backing plate 38 of each impeller 34a, 34b and the barrier walls 28 and between each impeller 34a, 34b and the confronting inner surface 43 of the housing 12 reduce tack flow of gas through the impeller chambers 25a, 25b when the blower 10 is in operation. In order to maintain the close tolerances between the impellers 34a, 34b and barrier walls 28 and between the impellers 34a, 34b and the confronting surfaces 43 of the housing 12, it is preferred that the shaft 22 and the impellers 34a, 34b be precisely balanced prior to assembly into the housing 12.

The impeller 34a illustrated in FIGS. 6–8 is the left impeller (with respect to FIG. 2) with the other or right impeller 34b illustrated in FIG. 2 being a mirror image of impeller 34a. As illustrated in FIG. 6, the impeller 34a, has blades 44 which are backward directed with respect to the direction of rotation of the impeller 34a. The blades 44 are integrally secured to the inner surface of the backing plate 38. The impeller blades 44, as can be best seen in FIGS. 6–8, spiral outwardly in one rotary direction of the impeller 34a. The distal boundary of each of the blades 44 extends obliquely and arcuately relative to the plane of the backing plate 38 from the hub 40 to a first predetermined point 46. The outward extension of the blades 44 is angled relative to the vertical plane of the inner face 50 of the hub 40. The distal boundary of each of the blades 44 then curves generally inwardly (toward the backing plate 38) with respect to the vertical plane of the inner face 50 of the hub 40, and diagonally with respect to a radius of the impeller 34a extending through the first predetermined point 46, to a second predetermined point 54. The distal boundary of each of the blades 44 then extends diagonally to a juncture with the outer end of the oblique section 42a of the backing plate 38 at the radial periphery of the impeller 34a.

As can be seen in FIG. 6, at the outer end of the backing plate 38 each blade 44 is bent proximate the second predetermined point 54 in the rotary direction opposite the rotary direction of the spiral of the impeller blades 44 and in the direction of rotation of the impeller 34a. The bent portions or tabs 56 formed in the impeller blades 44 proximate the second predetermined point 54 aid in reducing the vibration and noise associated with centrifugal displacement of the gas. The tabs 56 are believed to force exhaust gas from the impeller 34a in the rotational direction creating a positive pressure and an air pressure "ring" on the perimeter of the impeller 34a which reduces exhaust noise. The impeller blades 44 define channels through which the gas flows after being taken into the impeller chamber 25a. Preferably, the blades 44 are bent at an angle of from about 5 to 45 degrees.

Figure 19:
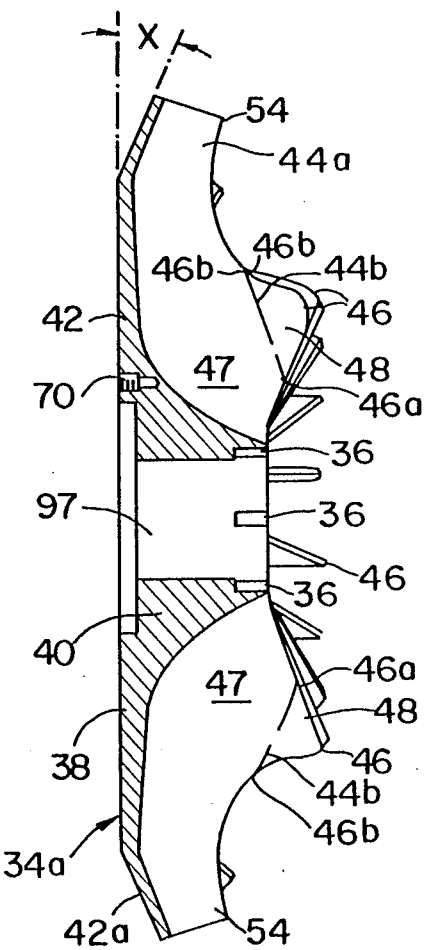
FIG. 19 is a sectional view taken generally along the plane of line 19—19 of FIG. 18.
Figure 18:
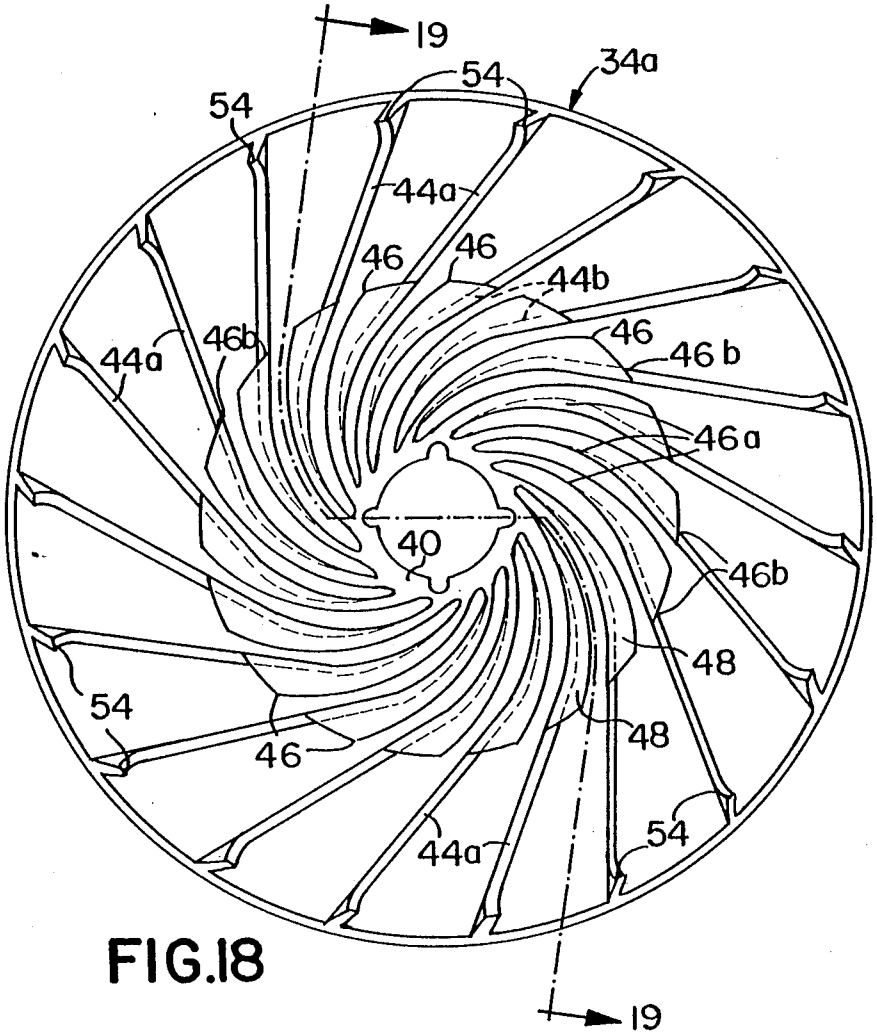
FIG. 18 is an elevational view of the inner side of a left impeller of another preferred embodiment of the invention.

The left impeller 34a of another presently preferred embodiment is shown in FIGS. 18 and 19. In this embodiment the impeller blades 44a are bent proximate the first predetermined point 46 in the direction of rotation of the impeller 34a increasing the volume flow rate of the blower 11a in which the impeller 34a is mounted. In this embodiment the distal boundary of each blade 44a extends obliquely, arcuately and perpendicularly relative to the plane of the backing plate 38 from the hub 40 to a third predetermined point 46a. The third predetermined point 46a is located on the distal boundary about one third the distance from the hub 40 to the first predetermined point 46. The blade 44a is bent between the third predetermined point 46a and a fourth predetermined point 46b, located about one third the distance along the distal boundary from the first predetermined point 46 to the second predetermined point 54. The fourth predetermined point 46b is positioned proximate the intersection of the walls of the housing 12 forming the left impeller chamber 25a and gas inlet chambers 115a when the impeller 34a is mounted in the dual blower 10. The blade 44a is bent along a line 44b extending between the third predetermined point 46a and the fourth predetermined point 46b in the direction of rotation of the impeller 34a to separate the blade 44a into a first section 47 extending generally perpendicularly relative to the plane of the backing plate 38 and a second, generally tabular section 48 extending at an angle relative to the first section 47 of the blade. In contrast to the embodiment illustrated in FIGS. 6–8, the distal boundary of the impeller blades 44a is generally rounded proximate the first predetermined point 46. The tabular second sections 48 are believed to aid in forcing air in the inlet chambers 115a, 115b into the channels formed between the blades 44a. The right impeller in this embodiment (not illustrated) is a mirror image of the left impeller 34a.

As illustrated in FIGS. 7 and 8, the outer side of impeller 34a, has a generally cylindrical generally axially centered recess 58 formed in the backing plate 38. The recess 58 confronts with an inner bearing cap 60

(FIG. 2) as will be hereinafter described in greater detail. Impeller 34a has a generally cylindrical, axially centered aperture 97 sized to fit around the shaft 22.

In one embodiment, illustrated in FIGS. 2, 7 and 8, a slot or keyway 96 is formed in the wall of the aperture 97. A corresponding key 64 (FIG. 2) extends within the slot 96 formed in each impeller 34a, 34b and within corresponding slots (FIG. 2) formed in the shaft 22 to lock the impellers 34a, 34b to the shaft 22 for concurrent rotation. Multiple keys may be employed to lock the impeller 34a to the shaft 22 (not shown).

In a presently preferred embodiment, illustrated in FIGS. 16–19, the impellers 34a, 34b are secured on the shaft 22, and rotation of the impellers 34a, 34b with respect to the shaft 22 is prevented by a plurality of pins 65 symmetrically positioned in shaft 22. As best seen in the perspective view of FIG. 17, each pin 65 has an elongated head 66 having a pair of parallel generally semicircular faces 66a, with a generally semicylindrical surface 66b and a generally rectangular surface 66c extending therebetween. Centered in and extending generally perpendicularly from the generally rectangular surface 66c is a generally cylindrical pin shaft 67.

Figure 16:
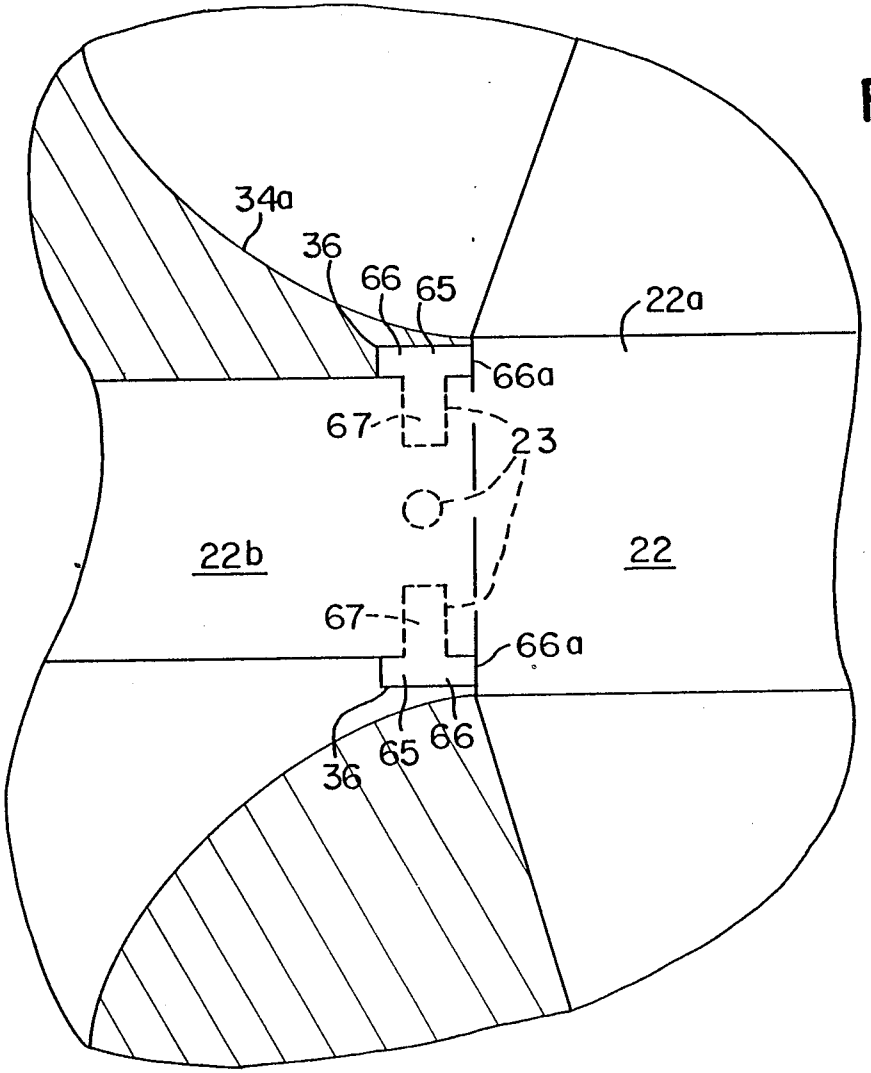
FIG. 16 is an expanded, broken, partially sectional vertical view of another preferred embodiment of the invention illustrating an alternative means of securing the impeller to the shaft employing pins.

As can best be seen in FIGS. 2 and 16, the shaft 22 includes a generally central first section 22a having an enlarged diameter with respect to the remainder of the shaft 22, and a pair of adjacent second sections 22b forming annular shoulders which are adapted for engagement with the annular inner face 50 of the hub 40 of each of the respective impellers 34a, 34b (as best seen in FIG. 2, 6 and 8). The enlarged diameter central portion 22a of the shaft 22 is substantially the same radial dimension as the face 50 of the impeller hubs 40 to provide a smooth transition surface.

As best seen in the broken, partial sectional view of FIG. 16, a plurality of radial bores 23 are formed in the second section 22b of the shaft 22. The bores 23 are sized to tightly engage with a press fit the pin shafts 67, and are positioned in the second section 22b at a distance from the first section 22agenerally corresponding to the distance between either face 66a of the pin head 66 and the axis of the pin shaft 67. Thus, when the pins 65 are press fit into the bores 23, contact between one of the pin faces 66a and the shoulder formed between the first section 22a and the second section 22b of the shaft 22 orients the pins 65 so that the pin heads 66 are maintained generally parallel to the longitudinal axis of the shaft 22. Preferably, the bores 23 are formed radially symmetrically in the shaft 22 in order to maintain the balance of the shaft 22.

As best seen in FIGS. 18 and 19, elongated generally semicylindrical slots 36 are formed in the walls of the apertures 97 of the left impeller 34a and right impeller 34b (not illustrated). The slots 36 each have an open end positioned in the face of the impeller 34a and a blind end. The slots 36 are positioned to align with the heads 66 of the pins 65 when the impeller 34a, 34b are mounted on the shaft 22 to lock the impellers to the shaft for concurrent rotation. The pins 65 can be quickly and accurately installed in the shaft 22 to provide a means for rotationally securing the impellers 34a, 34b to the shaft 22. The impellers 34a, 34b can be quickly mounted on the shaft 22 without dislodging or disturbing the orientation of the pins 65, in contrast to situations sometimes encountered when the impellers or the like are secured by keys.

As illustrated in FIGS. 2, 7 and 8, spaced radially outwardly of the generally cylindrical recess 58 on each impeller 34a, 34b is a plurality of threaded and tapped openings 70. The openings 70 are spaced uniform radial distances from the axial center of the respective impeller 34a, 34b. The openings 30 are used in disassembly of the blower, as discussed in detail below.

Shaft and Mounting Means

As seen in FIG. 2, generally annular bushings 68 are provided to confront and seal the outer side of each of the respective impellers 34a, 34b. The bushings 68 are positioned on the shaft 22 and extend into the generally cylindrical recess 58 in the outer side of the backing plates 38 of impellers 34a, 34b. A generally annular groove 69 formed in the shaft 22 proximate the outer surface of the impeller 34a, 34b receives a generally circular annular seal 69a to seal the bushing 68 adjacent the shaft 22.

The shaft 22 is rotatably mounted within the blower 10 by bearing assemblies 71. In the presently preferred embodiment illustrated in FIG. 2, the bearing assemblies 71 each include an inner bearing cap 60 which has a generally cylindrical portion 72 circumscribing the bushing 68. The cylindrical portion 72 is received into the recess 58 on the respective impeller 34a, 34b. The bearing assemblies 71 also include outer bearing cap members 76a, 76b which are adapted to be secured, for example, by means of threaded fasteners 78 or the like, to the respective end cap member 18a, 18b.

As can be best seen in FIGS. 2 and 10, the bearing cap member 76a on the left side of the blower 10 (with respect to FIG. 2) has an enlarged axially centered opening 80 through which extends the shaft 22 beyond the exterior of the blower 10 as shown in FIG. 2. The opening 80 is preferably provided with a seal member 82, preferably of the spring type, which is positioned in a generally annular recess in the outer bearing cap member 76a as shown in FIG. 2. The end of shaft 22 extending beyond the outer bearing cap member 76a is adapted for coupling to a prime mover P such as an internal combustion engine or the like for rotation of the shaft 22 and the impellers 34a, 34b relative to the housing 12.

As best seen in FIG. 2, the cap member 76b on the right end of the blower 10 (with respect to FIG. 2) differs from that on the left end in that the shaft 22 does not extend through the cap member 76b. Therefore, the bearing cap member 76b does not have any enlarged opening therein, but is provided instead with a smaller opening 84 which is preferably threaded and which has a removable threaded member 84a to provide a substantially fluid tight connection.

As best seen in FIG. 2, each of the integral end cap members 18a, 18b is provided with an axially centered generally cylindrical aperture 17 into which the shaft 22 and associated mounting means extend. Duplex bearings 90 are provided for rotation of the shaft 22 and associated impellers 34a, 34b with respect to the stationary housing 12 and associated barrier walls 28.

The shaft 22 has exterior threaded sections 86a, 86b adapted to receive associated interior threaded lock nuts 88 and lock washers 89 for positively locking and positioning the duplex bearings 90 on the shaft 22. The lock washers 89 have tabs which are positioned in key ways 89a formed in the shaft 22 proximate the ends thereof. As illustrated in FIG. 2, spring seals 92 of conventional type may be provided between the respective inner bearing cap 60 and bushing member 68. In addition, the outer bearing cap members 76a, 76b may be sealed by o-ring seals 93 as illustrated in FIG. 2, positioned in annular grooves formed in end cap members 18*a*, 18*b* and sealingly extending between the outer bearing cap members 76*a*, 76*b* and the hub 29 of the respective end cap member 18*a*, 18*b*.

Figure 20:
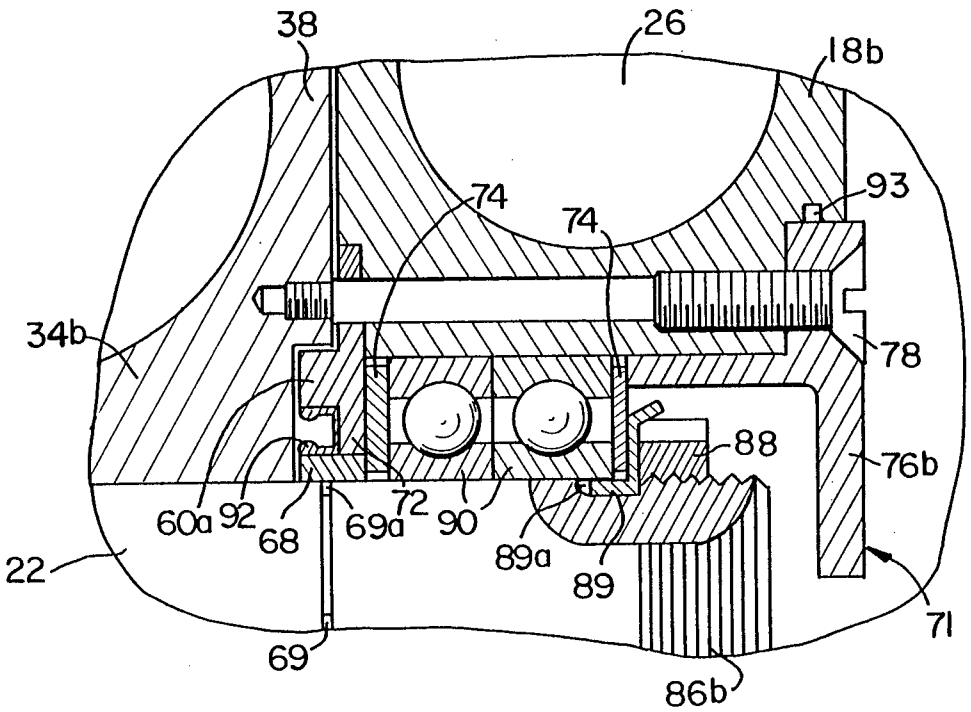
FIG. 20 is an expanded, broken, partially sectional vertical view of another preferred embodiment of the invention illustrating an alternative means of securing the end cap member and impeller to the right end (with reference to FIG. 2) of the shaft.

In a presently preferred embodiment, shown in FIG. 20, a broken partial sectional longitudinal view illustrating a portion of the right end (as viewed in FIG. 2) of the dual blower 10, the right outer bearing cap member 76*b* and right end cap member 18*b* are permitted to move slightly along the axis of the shaft 22 in proportion to the pressure of the gas in the plenum chambers 24, 26. A pair of "wavy" spring washers 74 are positioned on the shaft 22 on either side of the dual bearings 90 on the right end of the dual blower 10 to maintain the sealed condition of the dual blower 10 while simultaneously permitting limited motion along the shaft 22. As the pressure of the gas in the dual blower 10 increases, the right end cap member 18*b* moves outwardly (to the right in FIG. 20), expanding the interior volume of the dual blower 10 to relieve the internal pressure. In this embodiment, the spring seal 92 is oriented inwardly with respect to the inner bearing cap 60*a* in contrast to the embodiment illustrated in FIG. 2.

The bearing assemblies 71 may be maintained in lubricated condition by conventional lubricant disposed behind the respective outer bearing cap 76*a*, 76*b*. Preferably, the lubricant employed is a high speed grease lubricant rather than oil lubricant.

Bearing Replacement

If it becomes desirable or necessary to replace a bearing assembly 71 in the blower 10, this can be accompanied without disassembling the entire blower 10. For this purpose the outer bearing cap member 76*a*, or 76*b* of bearing assembly 71 can be removed by the removal of the associated threaded fasteners 78, and then the lock nut 88 and associated lock washer 89 can be backed off the respective end of the shaft 22, thus permitting the outward axial removal of the bearings 90.

Next, a suitable conventional puller or like mechanism (not illustrated but similar to a gear puller) can be used employing the respective end of the shaft 22 as the bearing point. Elongated threaded bolt members (not illustrated) are inserted through openings 94 (FIG. 2) extending through the respective end cap members 18*a*, 18*b*. The bolt members are threaded into the openings 70 in the respective impeller 34*a*, 34*b*. Thereupon, the threaded fasteners 21 can be removed from the end cap member 18*a*, 18*b* so that the end cap member 18*a*, 18*b* is no longer secured to the respective end of the blower housing 12.

The puller can be actuated using the confronting end of the shaft 22 as the bearing point for the conventional threaded actuator of the puller to pull the attached impeller 34*a*, 34*b*, the bearing assembly 71, and the integral end cap member 18*a*, 18*b* including the end plate 19, the hub portion 29, and the barrier wall 28, completely off the shaft 22 and out of the associated end of the housing 12, thus enabling expeditious replacement or repair of the bearing assembly 71.

Figure 17:
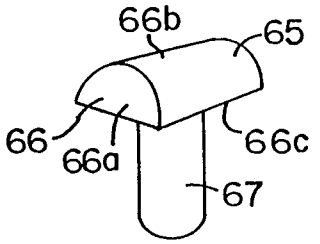
FIG. 17 is an expanded perspective view of a pin used in the embodiment of FIG. 16.

The new or repaired bearing assembly 71 can then be reassembled with the end cap member 18*a*, 18*b* and the impeller 34*a*, 34*b* to form a subassembly (not illustrated). Then the subassembly is moved axially inwardly on the shaft 22 and into the housing 12 to reassemble the impeller 34*a*, 34*b*, and the bearing assembly 71 on the shaft 22, with keys 64 being received within the key slots 96 in the impellers 34*a*, 34*b* to again fix the impellers 34*a*, 34*b* to the shaft 22. In the preferred embodiment discussed above, the pins 65 are positioned in the bores 23 in the shaft 22 (FIGS. 16, 17 and 18).

The fasteners 21 can then be reinstalled to secure the end cap member 18*a*, 18*b* to the housing 12, and the lock washer 89 and lock nut 88 can then be replaced on the end of the shaft 22. The outer bearing cap 76*a*, 76*b* can be fastened by means of their associated fasteners 78 to the respective end cap member 18*a*, 18*b*. Thus, it is seen that it is possible to conveniently replace or repair the bearings of one of the two individual blowers 11*a*, 11*b* of the dual blower 10 without the necessity of complete disassembly of the entire dual blower 10.

Gas Inlet and Outlet

Figure 3:
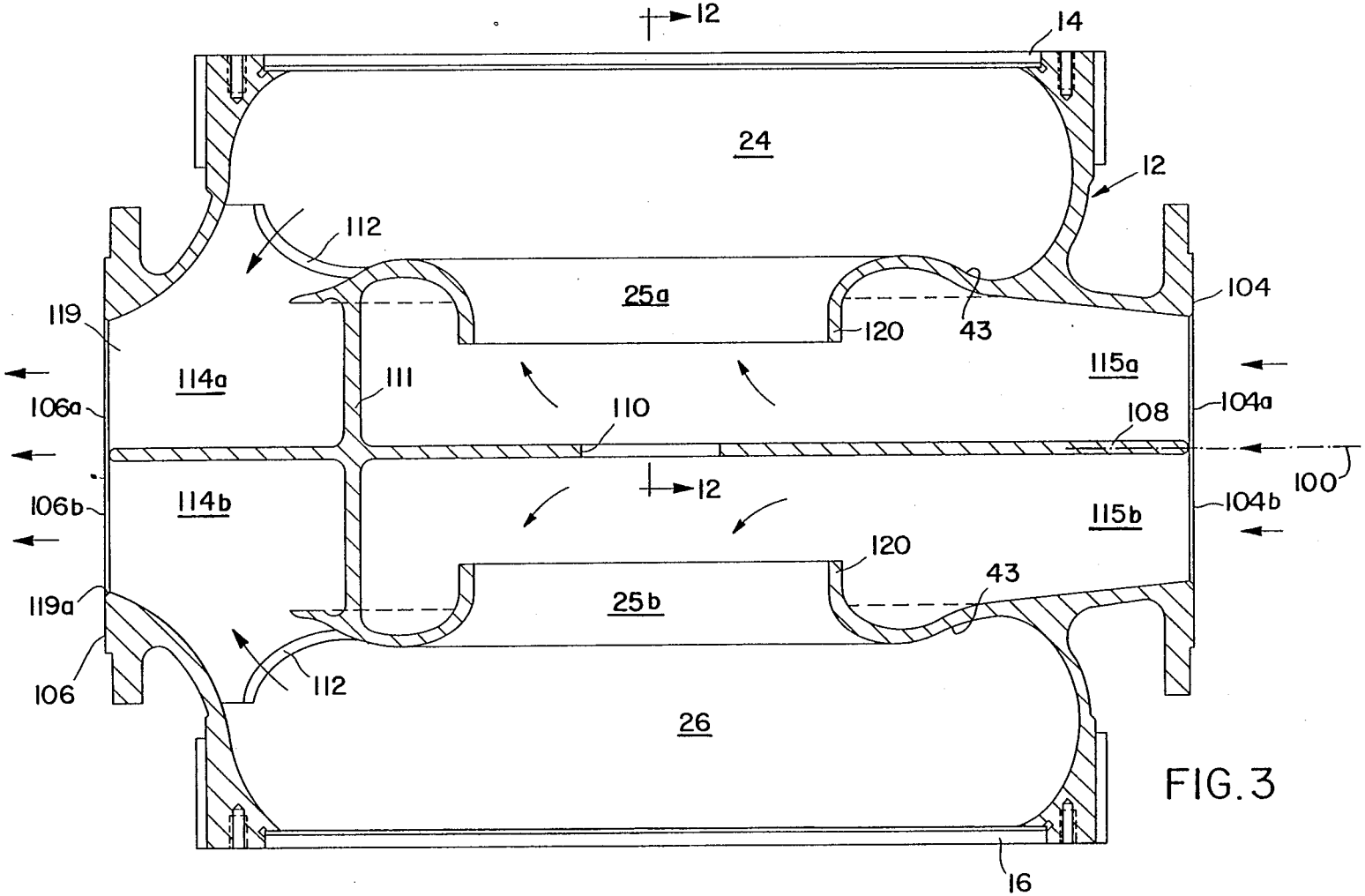
FIG. 3 is a horizontal sectional view taken generally along the plane of line 3—3 of FIG. 1.

As can be best seen in FIGS. 2 and 3, a gas inlet 104 is provided on the upstream or intake side of the blower 10 for drawing gas into the dual blower 10 and a gas outlet 106 is disposed on the downstream or exhaust side of the blower 10 for exhausting pressurized gas from the dual blower 10. The blower inlet 104 and blower outlet 106 are aligned with each other and may be referred to as "in-line." Thus, the dual blower 10 may be placed within an existing pipeline (not shown) without extensive displacement or replacement of the existing pipe. A center line 100 passing through blower inlet 104 and the blower outlet 106 (FIG. 3) is generally perpendicular to (or "crosswise of") the shaft 22 and the axis of the housing 12.

A wall 108 extends generally transversely with respect to the longitudinal axis of the blower 10 and divides the dual blower 10 into two completely separate sections. Each of the blower sections functions substantially as a separate blower 11*a*, 11*b*. The wall 108 divides the incoming gas into two generally equal volume streams. The inlet 104 to the dual blower 10 is thus divided into a right inlet 104*a* and a left inlet 104*b* (with respect to FIG. 3). The wall 108 separates a pair of generally tubular inlet chambers 115*a*, 115*b* which extend from the two respective separate inlet openings 104*a*, 104*b* of the blower inlet 104 to the respective impeller chambers 25*a*, 25*b*. The inlet chambers 115*a*, 115*b* are radially symmetric proximate the impeller chambers 25*a*, 25*b*. The inlet chambers 115*a*, 115*b* are shaped to encourage turbulent flow which aids in dispersing liquids entrained in the gaseous intake to the blower 10. Further, each of the impellers 34*a*, 34*b* protrudes slightly into the respective inlet chamber 115*a*, 115*b* thereby imparting whirl to gas in the respective inlet chamber 115*a*, 115*b* in operation of the blower 10.

The wall 108 also divides the in-line gas outlet 106 into a pair of outlet openings 106*a*, 106*b*. The wall 108 further divides a pair of gas outlet chambers 114*a*, 114*b* which receive exhaust gas from the generally radially symmetric plenum chambers 24, 26 through gas outlet openings 112 in the housing wall separating the plenum chambers 24, 26 from the respective outlet chambers 114*a*, 114*b*.

As illustrated in FIGS. 2, 4 and 5, a plurality of generally planar gas flow-directing vanes 33, 33*a* are formed integrally in the end cap members 18*a*, 18*b* and extend between each of the barrier walls 28 and the respective end cap member 19. The vanes 33, 33*a* are oriented to extend generally parallel to the shaft 22 when the dual blower 10 is assembled. As best seen in FIG. 2, the planes formed by the vanes 33, 33*a* extend at an angle to the radius of the end cap members 18*a*, 18*b*; preferably, the angle is about 30 degrees. The majority of the vanes 33 are oriented at an angle which is opposed to the direction of rotation of the corresponding impeller. For example, the left impeller 34a rotates clockwise when viewed from the left side of the dual blower 10. Thus, the majority of the vanes 33 formed in the left end cap member 18a are oriented at a small angle measured counterclockwise from the radial direction. A single vane 33a, positioned in the upper portion of the left end cap member 18a and proximate the gas outlet opening 112 when the left end cap member 18a is assembled in the dual blower 10, is oriented in a direction opposed to the majority of the vanes 33. As best seen in FIG. 2, the right end cap member 18b has a plurality of vanes 33, 33a corresponding to those formed in the left end cap member 18a. The vanes 33, 33a aid in directing and diffusing flow of gas leaving the impeller chambers 34a, 34b and entering the plenum chambers 24, 26 and aid in directing the gas into the gas outlet openings 112.

The gas outlet openings 112 are elongated in a direction perpendicular to the axis of rotation of the shaft 22 and impellers 34a, 34b (best seen in FIG. 9). As can be seen in FIGS. 1, 3, 9 and 10, the outlet openings 112 provide fluid communication between each of the plenum chambers 24, 26 and the respective outlet chambers 114a, 114b. The openings 112, as can be best seen in FIGS. 1 and 9, are preferably vertically elongated. While most of the gas discharged from the impellers 34a, 34b flows into and expands in the plenum chambers 24, 26, a portion of the gas is directed into the gas outlet openings 112. This creates an injectorlike action which tends to suck the gas in the plenum chambers 24, 26 through the gas outlet openings 112 into the outlet chambers 114a, 114b. This unique action makes the flow from the impellers 34a, 34b and the plenum chambers 24, 26 very quiet and uniform, which allows the dual blower 10 to be constructed from a light weight material and with a relatively compact configuration.

In one presently preferred embodiment of the present invention, the blower gas inlet 104 is secured to a supply pipe member (not illustrated) which has an interior diameter spanning at least portions of both of the inlet chamber openings 104a, 104b. Preferably, the interior diameter of the pipe member is about equal to the interior diameter of the blower gas inlet 104. Thus, approximately equal volumes of gas are drawn into the inlet chambers 115a, 115b of the dual blower 10 during operation.

The extension of the wall 108 which forms separate outlet chambers 114a, 114b for each of the individual blowers 11a, 11b reduces internal turbulence by separating the flow to each of the impeller chambers 34a, 34b, which, if permitted to occur, would create additional heat thereby reducing the efficiency of the dual blower 10. The wall 108 has an opening 110 therethrough through which extends the rotary shaft 22 of the dual blower 10. A transverse wall 111 illustrated in FIG. 3 closes the ends of the inlet chambers 115a, 115b of the blower housing 12 and separates the inlet chambers 115a, 115b from the outlet chambers 114a, 114b.

The exterior of the housing 12 proximate the blower inlet chambers 115a, 115b is of a generally cylindrical configuration as can be best seen in FIG. 2. The outlet chambers 114a, 114b are defined by walls of more boxlike configuration, and comprise upper and lower generally planar wall sections 118, 119 as best seen in FIG. 9. However, the gas outlet opening 119a (FIG. 9) is preferably of circular configuration and the two gas outlet openings 106a, 106b of the individual blowers 11a, 11b are preferably of semicircular configuration. The gas outlet opening 119a may have the same diameter as the circular opening at the inlet 104 to the dual blower 10. The wall sections 118, 119 merge smoothly with gas outlet opening 119a from the blower, as do the defining side wall portions of the outlet chambers 114a, 114b (FIG. 3). Both the dual blower gas inlet 104 and gas outlet 106 are preferably flanged in the conventional manner so that they may be easily, securely, and removably fitted to standard flanged pipe sections (not shown).

Parallel Operation

As illustrated in FIG. 3 by the full line arrows, when the individual blowers 11a, 11b are operated in parallel, generally equal amounts of entering gas flow into the inlet chambers 115a, 115b and are subsequently drawn into the impeller chambers 25a, 25b. As shown in FIG. 2 the impeller chambers 25a, 25b are in fluid communication with the plenum chambers 24, 26 so that gas from the inlet chambers 115a, 115b is generally discharged by operation of the impellers 34a, 34b into the plenum chambers 24, 26 with a portion being discharged directly into the outlet chambers 114a, 114b through the gas outlet openings 112. The portions of the impeller chambers 25a, 25b which extend radially beyond the impellers 34a, 34b and the plenum chambers 24, 26 constitute radially symmetric diffusers, having a generally radially symmetric distribution of statical pressure. From the plenum chambers 24, 26 the gas flows through the gas outlet openings 112 into the outlet chambers 114a, 114b and subsequently is exhausted from the blower through the outlet openings 106a, 106b forming the dual blower outlet 106.

Series Operation

Figure 14:
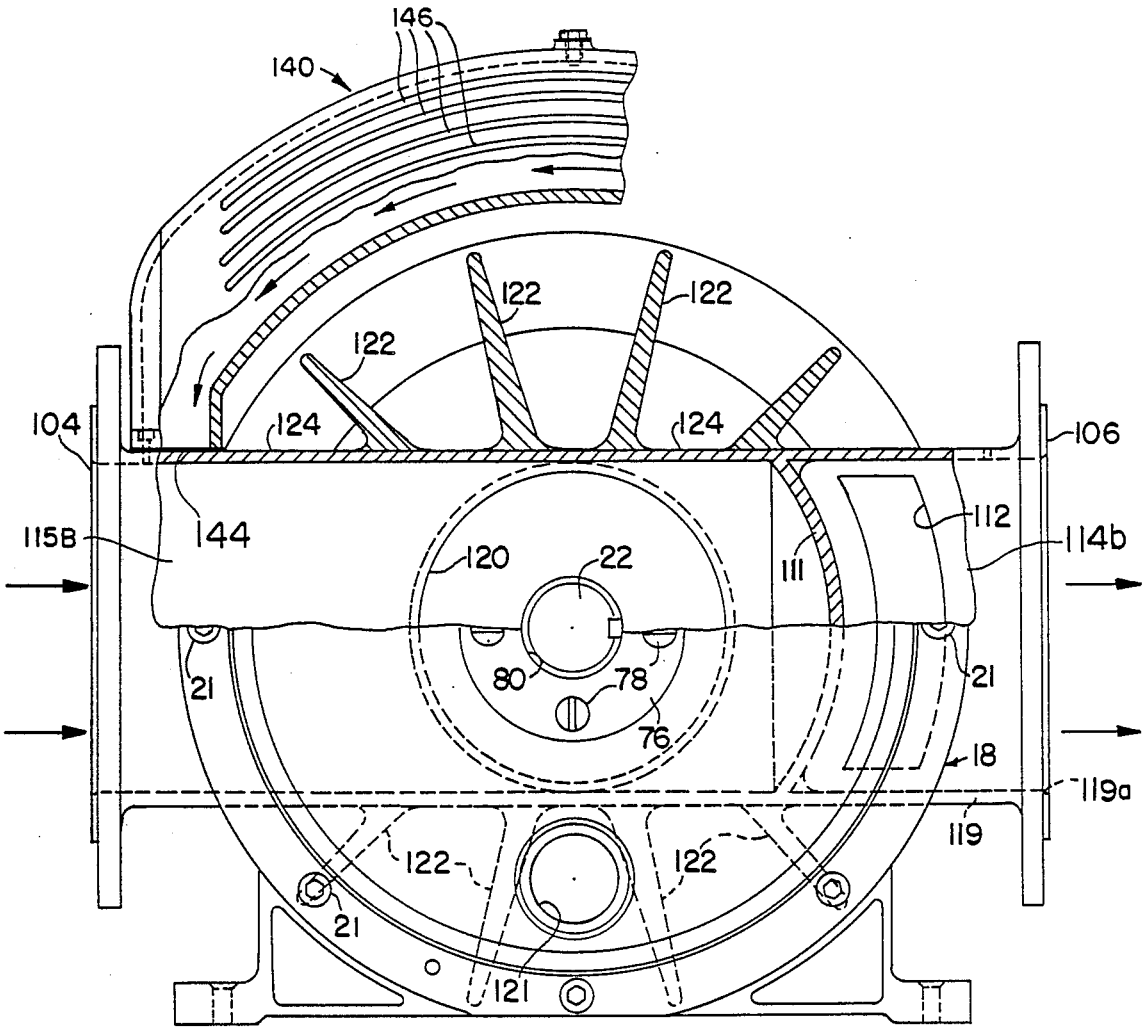
FIG. 14 is a partially broken, end elevational view of another preferred embodiment of the invention taken from the left end (with reference to FIG. 2) of the blower, the ribs on the end plate having been deleted.
Figure 15:
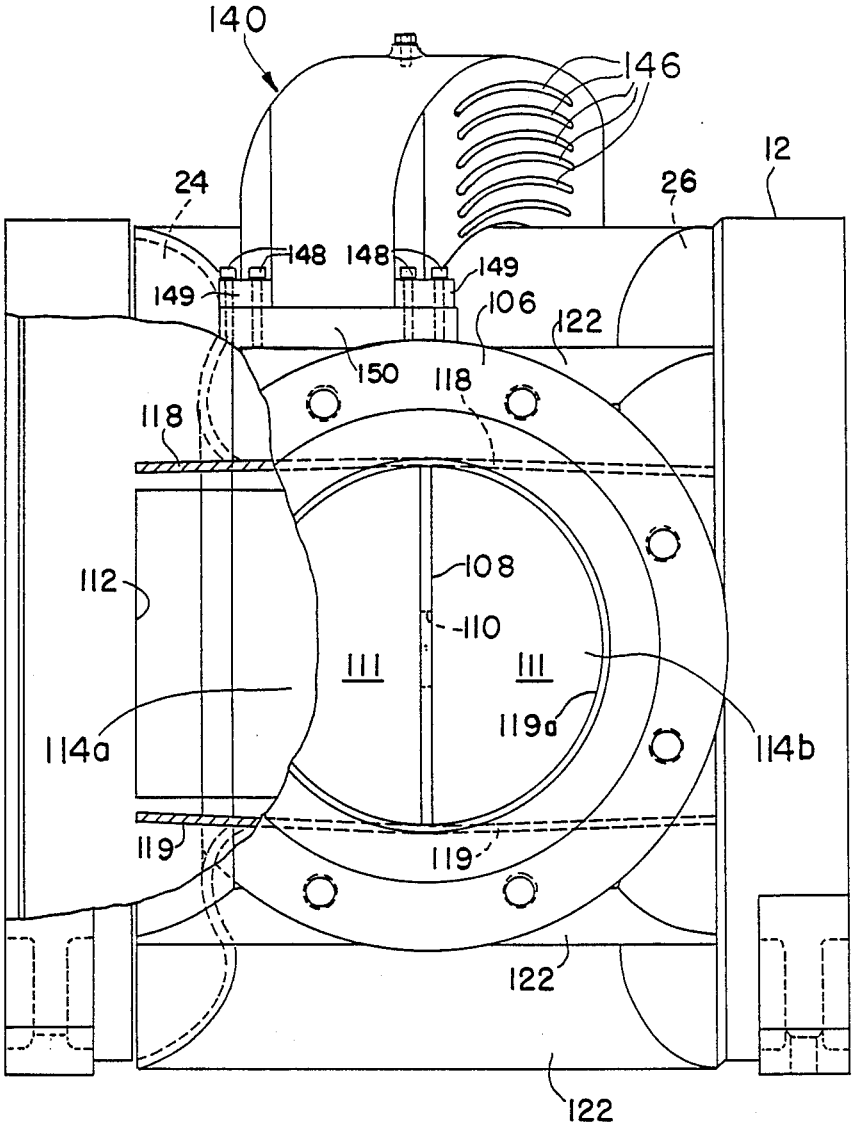
FIG. 15 is a partially broken elevational view of the blower housing of the embodiment illustrated in FIG. 14 with the end plates deleted taken from the gas outlet side of the blower.

In another presently preferred embodiment of the present invention, illustrated in FIGS. 14 and 15, gas flows through a special inlet pipe member having a semi-circular interior cross section proximate its outlet and known as a 50 percent blind reducer (not illustrated). Gas flows from the 50 percent blind reducer into only one of the two inlet openings 104a, 104b to the inlet chambers 115a, 115b of the dual blower 10. For example, the left inlet opening 104b (with respect to FIG. 3) may be closed by the plate member and gas will then flow only into the right inlet opening 104a.

The gas then flows successively from the inlet chamber through one 11a of the individual blowers 11a, 11b comprising the dual blower 10 and is discharged from an exit opening formed in the upper wall 118 of one 114a of the two outlet chambers (FIG. 15). A generally tubular manifold 140 provides fluid communication from the special outlet opening of this outlet chamber 114a to an inlet opening 144 in the upper wall of the other 115b of the two inlet chambers. Gas is further compressed by flow through the second 11b of the two individual blowers 11a, 11b comprising the dual blower 10 and is exhausted from the other of the two outlet chambers 114b of the dual blower 10. The outlet 106 of the dual blower 10 is also preferably fitted with a 50 percent blind reducer in this embodiment (not illustrated).

The manifold 140 may be fitted with cooling fins 146 to aid in dissipating heat generated during passage of the gas through the first of the two individual blowers 11a, 11b. The manifold 140 may be fastened to mounting plates 150 cast into the housing 12 of the dual blower 10 with threaded fasteners 148. The manifold 140 comprises means for placing the inlet chamber of one of the individual blowers in fluid communication with the outlet chamber of the other of the individual blowers. In this embodiment, the mass flow of gas through the dual blower 10 is reduced by about one half in comparison with the mass flow of the embodiment in which gas is taken into both of the intake chambers 115*a*, 115*b* from the gas supply to the dual blower 10. However, when the individual blowers 11*a*, 11*b* of the dual blower 10 are connected in series in this manner, the pressure of the gas exhausted from the dual blower 10 is substantially increased in comparison with the pressure of the gas exhausted from the dual blower 10 when the individual blowers 11*a*, 11*b* of the dual blower 10 are operated in parallel.

Reduction of Bearing Loads

Each of the individual blowers of the present invention has reduced axial end thrust in comparison with centrifugal blowers of conventional design. As best seen in FIG. 2, each impeller 34*a*, 34*b* is mounted on the drive shaft 22 for rotation within the respective impeller chamber 25*a*, 25*b*. Each impeller 34*a*, 34*b* is adapted for generally axial intake of gas from the respective inlet opening communicating with the respective inlet chamber 115*a*, 115*b*. Further, each impeller 34*a*, 34*b* is adapted for generally centrifugal radially symmetric exhaust of the gas. However, the exhaust gas has an axial component of force in the axial direction opposite to the direction of gas intake. The radial component of force of the gas exhaust from the impellers 34*a*, 34*b* is radially symmetric, reducing the radial load on the blower bearings 90, in contrast to prior art blowers having volutes with growing outer radius which impose high radial loads on the bearings.

Preferably, the axial component of force of the gaseous intake to the impeller 34*a*, 34*b* is about equal in magnitude to the axial component of force of the gaseous exhaust from the impeller 34*a*, 34*b*. When these forces are thus balanced, each of the individual blowers 11*a*, 11*b* of the dual blower 10 possesses minimum end thrust during the operation thereof. In prior art mixed flow gas blowers, the axial components of force of the gas intake to the impeller and exhaust from the impeller are not balanced, and often are additive.

In the presently preferred illustrated embodiments the magnitude of the axial component of force of gas exhausted from each impeller 34*a*, 34*b* is governed by the angle X which the generally obliquely extending section 42*a* of the backing plate 42 of each impeller 34*a*, 34*b* makes with a plane perpendicular to the axis of the blower. This angle X is the same as that previously considered regarding the barrier walls 28. As the magnitude of the angle X is increased, the axial component of force of the gas exhausted from the impeller 34*a*, 34*b* increases. Conversely, when the angle X is decreased, the axial component of force of the gas exhausted from the impeller 34*a*, 34*b* decreases. As discussed above, the presently preferred value for angle X is 22.5 degrees because the axial thrust of each of the impellers 34*a*, 34*b* is minimized at this angle.

In the presently preferred dual blower embodiments illustrated, the residual end thrusts of the individual blowers comprising the dual blower are opposed in direction so as to balance one another. Thus, substantially zero thrust is applied to the bearing structure during operation of the dual blower 10. Further, the axial force balance of the individual blowers 11*a*, 11*b* making up the dual blower 10 of the illustrated presently preferred embodiments is independent of the angular velocity of the shaft 22 and impellers 34*a*, 34*b* of the blower 10.

Entrained Liquid in Intake

In addition to the reduced thrust, the present invention provides several other advantages. For example, blowers of the present invention are adapted to receive gas containing entrained liquid or condensible gas such as sanitary landfill gases in which the moisture concentration may reach up to about 70 percent of the total flow. Preferably, as best seen in FIG. 2, a portion of the impellers 34*a*, 34*b* protrudes into the respective inlet chamber 115*a*, 115*b*. In operation of the blower the projecting portion of the impellers 34*a*, 34*b* into the inlet chambers 115, 115*a* imparts whirl to the gas contained in the inlet chambers. As discussed above, turbulent flow within the inlet chambers serves to break up and disperse liquid droplets which may be entrained in the gaseous intake to the blower. This dispersion of entrained liquid reduces the likelihood of catastrophic failure of the blower 10 associated with sudden changes in the density of the fluid flowing through the blower 10.

Noise and Vibration Reduction

The blower of the present invention also exhibits a low operational noise level. For example, a blower of the present invention may exhibit a noise level of under 90 decibels in comparison with greater than 100 decibels for a conventional centrifugal blower of the prior art, and of greater than 150 decibels for a conventional turbocharged blower. While not wishing to be bound to a particular theory or explanation of the noise reduction, it is believed that the noise reduction is related to the design of the impellers 34*a*, 34*b* and the flow path of gas through the dual blower 10.

The blower of the present invention also exhibits advantageously reduced vibration in comparison with prior art blowers. This is manifested in several desirable characteristics. At high operating angular velocities, such as achievable by blowers of the present invention, high local pressures occur proximate the impellers, and especially in the fluid boundary layer proximate the impeller surfaces. The high local pressures may result in the condensation of condensible gases contained by the fluid being compressed by the blower. In prior art blowers, liquids condensing on the surface of the impeller tend to cavitate.

Cavitation in the liquid results in accelerated wear of the surfaces of the impeller and may ultimately result in catastrophic failure of the impeller during operation of the prior art blower. Further, cavitation tends to result in undesired vibrations in the rotating impeller which may in turn result in accelerated failure of the impeller and excessive, undesirable noise. The present invention provides an impeller of a design which reduces the likelihood that liquid condensed on the impeller surface will cavitate causing failure of the blower. In order to achieve reduced cavitation in the illustrated embodiments, the acute angle X made by the obliquely inwardly extending section 42*a* of the backing plate 38 of the impeller 34*a*, 34*b* is selected to be in the range from about 5 to 45 degrees.

Pressure Relief

Another advantage of the present invention relates to pressure relief provided for the plenum chambers for venting the plenum chambers. The pressure relief mechanism may be provided to advantageously discharge excessive pressure built up in the plenum chambers 24, 26, such as may occur when liquid entrained in or condensed from the intake gas to the blower collects in the plenum chamber, thereby preventing possible catastrophic failure of the blower 10. Each end cap member 18*a*, 18*b* is preferably provided with a threaded opening 121 in the end cap section 19. The opening 121 is adapted to receive in coacting threaded relationship a pressure relief valve (not illustrated) for providing pressure relief for the respective plenum chamber 24, 26 of the blower. The pressure relief valve may be of any conventional type. Many relief valve mechanisms are known in the art. One commercially available pressure relief valve is supplied by Fisher Controls Company of Cleveland, Ohio. The pressure relief mechanism may be set, for example, to open and relieve the pressure in the respective plenum chamber 24, 26 at approximately 20 PSIG. In addition, or in the alternative, the openings 121 can be fitted with reans (not illustrated) to recycle condensate back to the inlet chambers 115*a*, 115*b* of the blower.

Efficiency

The blower 10 of the present invention is significantly more efficient than comparable capacity blowers of the prior art. This is evidenced by the fact that the illustrated presently preferred embodiments of the invention exhibit substantially reduced operating temperatures in comparison with prior art blowers. For example, the temperature increase imparted to methane gas compressed by a blower of a present invention has been found to be about 70 degrees F. in comparison to a temperature rise of about 140 degrees F. shown by a comparable capacity blower of the prior art. The reduction in operating temperature implies a greater proportion of the input energy is transformed by the blower into gas pressure and velocity and less is dissipated as heat. Further, blowers of the present invention require substantially less energy input than comparable capacity prior art blowers.

Depending on the size of the compressor frame and the configuration of the individual blowers 11*a*, 11*b* (in series or in parallel), a dual blower according to the present invention is adapted to receive gas at a minimum pressure at the inlet opening 104 and to discharge the gas at the outlet opening 106 at a pressure of, for example, between 2 and 8 PSIG, and at a volume flow rate ranging from 500 to 7,500 standard cubic feet per minute. The shaft 22 and impellers 34*a*, 34*b* may rotate at between 3,000 to 12,000 RPM to achieve desired flow rates, pressures and vacuums. The dual blower 10 of the present invention provides substantial vacuum at its inlet 104. The inlet vacuum may range up to 14 inches of Hg, depending on frame size, rotational operating speed, configuration, et al.

The blower 10 of the present invention may be expeditiously formed of aluminum alloy castings so that this invention provides a relatively light weight blower mechanism that is fairly readibly portable. Preferably, a non-sparking aluminum alloy is chosen for construction of the blower 10 to provide safety when the blower 10 is used to compress flammable or explosive gases such as methane and the like. It is also preferable that aluminum parts used in the dual blower 10 be anodized for corrosion resistance when the dual blower 10 is to be employed in moving corrosive gases.

Blower Mounting

The present invention provides a gas blower which has significantly greater mounting flexibility than prior art blowers. For example, the shaft 22 may be mounted to extend from either the left or right side of the dual blower 10. A blower having the shaft extending from the left of the blower, such as illustrated in FIG. 2, may be easily and quickly converted so that the shaft extends from the right side of the blower by removing each of the end cap members, bearing assemblies, and impellers, as units from the shaft 22 as described above. The axial orientation of the shaft 22 is reversed and the impellers, bearing assemblies, and end cap members are reinstalled in the ends of the blower housing 12 opposite the ends from which they were withdrawn.

The presently preferred illustrated embodiments of the dual blower may be easily mounted within a pipe system. As indicated above, the inlet opening 104 and outlet opening 106 of the dual blower may include conventional flanges adapted for securing the blower to inlet and outlet pipes (not illustrated) having confronting flanges in any conventional manner.

The shaft 22 of the blower 10 may be directly coupled to the prime mover P illustrated in FIG. 2. Alternatively, a pulley member or the like may be secured by conventional means to the outwardly extending portion of the shaft 22, and the pulley may be coupled to the prime mover P through a drive belt, drive chain, or the like. When used with a blower, a single pulley drive creates a lateral force on the bearings which must be balanced to avoid premature bearing failure. To overcome the lateral force which a single pulley drive exerts in the blower's bearings, a dual motor drive can be used. In the dual motor drive a pair of motors are connected to a pair of pulleys mounted on the shaft by a pair of drive belts (not illustrated). The motors are positioned to balance the lateral forces acting on the shaft 22 of the dual blower 10.

Gas Mixing Use

The dual blower 10 of the present invention is also useful in mixing gases drawn from two different streams. The inlet opening 104 to the dual blower 10 may be fitted with a special pipe section (not illustrated) which is divided longitudinally by a wall separating two compartments, each of which may be connected to a different gas source. The gas from each source is compressed in one of the individual blowers 11*a*, 11*b* of the dual blower 10. The outlet 106 of the dual blower 10 is fit with a pipe section having a single interior space in which the gases exhausted from the two individual blowers 11*a*, 11*b* of the dual blower 10 mix, and depending on the characteristics of the two gases, react chemically.

From the foregoing description and acccompanying drawings it is seen that the present invention provides in one presently preferred embodiment a novel mixed flow blower comprising a pair of individual balanced blower units. The dual blower possesses minimum end thrust and radial forces applied to the shaft and the associated bearings during operation. The invention also provides a novel relatively light weight blower mechanism adapted for example to move gas through a pipeline system at a relatively high flow rate, wherein means are also provided for expeditiously replacing the bearing structure of the blower without the necessity of disassembling the entire blower.

It will recognized by those skilled in the art that changes may be made to the above-described embodiments of the invention without departing from the broad inventive concept thereof. It is understood, therefore, that this invention is not limited to the particular embodiments disclosed, but is intended to cover all modifications which are within the scope and spirit of the invention which are defined by the appended claims.

I claim:

1. A centrifugal, inline, opposed balanced gas blower comprising a housing having a pair of opposed end walls aligned at opposite ends of a central axis, the housing including a pair of opposed, axially spaced, generally annular radially symmetric impeller chambers;

a pair of opposed, axially spaced, generally annular, radially symmetric plenum chambers, each plenum chamber being disposed between an impeller chamber and the end wall closest to the impeller chamber, a radial outer portion of each impeller chamber being in communication for the flow of gas to a radial outer portion of the respective plenum chamber;

a pair of opposed, axially spaced, generally annular, radially symmetric deflectors, each connected to the end walls and disposed between the impeller chamber and the respective plenum chamber;

a rotatable drive shaft extending along the central axis into the plenum chambers and the impeller chambers;

a dividing wall extending perpendicular to the central axis through which the drive shaft extends;

a pair of gas inlets formed in the housing so that gas enters the housing on opposite sides of the dividing wall;

a pair of gas outlets formed in the housing opposed to and aligned with the gas inlets along a transverse axis perpendicular to the central axis so that gas is exhausted from the housing through the gas outlets from opposite sides of the dividing wall;

a pair of impellers mounted on the drive shaft, each disposed in the respective impeller chamber for rotation with respect there to; and a pair of opposed, axially spaced inlet gas chambers for receiving gas from the gas inlets and for directing gas axially to the impellers;

each plenum chamber having an outlet portion including an exhausts gas displacement port formed in an inward radial wall of the plenum chamber in communication with an outlet gas chamber which is in communication with the gas outlet, the impellers being adapted for generally axial intake of gas from the in let gas chambers and generally centrifugal radially symmetric exhaust of the gas to the plenum chambers to initially pressurize the plenum chambers from which gas is displaced through the exhaust gas displacement ports, the impellers, impeller chambers, plenum chambers and deflectors being disposed in the housing such that there is substantially no axial load on the shaft.

2. A blower according to claim 1 wherein the deflectors extend generally radially outwardly with respect to the central axis to a radial periphery, the radial periphery of the deflectors defining the greatest outward radial extension of the impeller chambers, and a generally annular passageway extends between the radial outer periphery of each impeller chamber and the radially outer portion of the adjacent plenum chamber for providing fluid communication between the impeller chambers and the plenum chambers; whereby the radial length of the deflector determines the mass flow through the blower at a given rotational speed of the impellers.

3. A blower according to claim 2 wherein the radial periphery of the deflectors extends a greater radial distance from the central axis than the radial periphery of the impellers.

4. A blower according to claim 2 wherein each deflector includes a generally radially outwardly extending section, and a generally inwardly obliquely extending section projecting from the distal end of the radial section toward the center of the blower at an acute angle with respect to a plane perpendicular to the central axis.

5. A blower according to claim 4 wherein the acute angle is from about 5 degrees to 45 degrees.

6. A blower according to claim 5 wherein the acute angle is about 22.5 degrees.

7. A blower according to claim 1 wherein each impeller includes a backing plate and a plurality of impeller blades secured to the backing plate and generally spiralling outwardly in one rotary direction of the impeller, the distal boundary of each of the blades extending obliquely arcuately relative to the plane of the backing plate to a first predetermined point and then curving inwardly toward the plane of the backing plate and radially outwardly in the direction of the periphery of the backing plate to a second predetermined point, and then extending diagonally to merge with the backing plate at the radial periphery of the impeller.

8. A blower according to claim 7 wherein the blades are bent proximate the first predetermined point in the direction of rotation of the impeller.

9. A blower according to claim 7 wherein the impeller blades are bent proximate the second predetermined point in the rotary direction of the impeller opposite the rotary direction of the spiral of the impeller blades.

10. A blower according to claim 7 wherein the backing plate of each impeller is formed generally complementary to the deflector, and the inner surface of the housing has portions adjacent to the impeller blades proximate the generally obliquely extending section of the deflector wall which are formed generally complementary to the obliquely extending section of the deflector.

11. A blower according to claim 7 wherein the housing has an inner surface including portions adjacent to the impeller blades and defining a boundary of each impeller chamber, wherein the distal boundary of each blade between the first and second predetermined points is positioned in close proximity to the adjacent portion of the inner surface of the housing, and wherein the backing plate of each impeller is positioned in close proximity to the deflector, whereby backflow through the impeller chamber is reduced.

12. A blower according to claim 1 wherein the housing has a removable cover member in each end wall proximate the plenum chamber.

13. A blower according to claim 12 including a pair of bearing assemblies spaced axially from the impellers and rotatably mounting the drive shaft, and means on the impellers and the cover members providing for axial removal of the cover members, the bearing assembly, and the impellers from the housing endwise of the drive shaft.

14. A blower according to claim 1 wherein each exhaust gas displacement port is an elongated opening communicating the respective plenum chamber with the respective outlet gas chamber, the exhaust gas displacement port being elongated in a direction perpendicular to the central axis.

15. A blower according to claim 1 wherein a portion of each impeller protrudes into the respective inlet gas chamber, thereby imparting whirl to gas in the inlet gas chambers during operation of the blower.

16. A blower according to claim 1 additionally comprising pressure relief means for venting the plenum chambers should the pressure within the plenum chambers exceed a predetermined magnitude.

17. A blower according to claim 1 adapted for operation in series, comprising means for placing the inlet gas chamber on one side of the dividing wall in fluid communication with the outlet gas chamber on the other side of the dividing wall.

* * * * *